US006296367B1

(12) United States Patent
Parsons et al.

(10) Patent No.: US 6,296,367 B1
(45) Date of Patent: Oct. 2, 2001

(54) RECHARGEABLE FLASHLIGHT WITH STEP-UP VOLTAGE CONVERTER AND RECHARGER THEREFOR

(75) Inventors: Kevin L. Parsons, Appleton, WI (US); W. Clay Reeves, Dallas, TX (US)

(73) Assignee: Armament Systems and Procedures, Inc., Appleton, WI (US)

( * ) Notice: Subject to any disclaimer, the term of this patent is extended or adjusted under 35 U.S.C. 154(b) by 0 days.

(21) Appl. No.: 09/419,030

(22) Filed: Oct. 15, 1999

(51) Int. Cl.[7] ..... F21L 4/08

(52) U.S. Cl. ..... 362/183; 362/202; 362/206; 320/115

(58) Field of Search ..... 362/183, 202, 362/205, 206; 320/113, 114, 115

(56) References Cited

U.S. PATENT DOCUMENTS

| | | | | |
|---|---|---|---|---|
| 3,521,050 | | 7/1970 | Shagena, Jr. | 362/183 |
| 3,810,212 | * | 5/1974 | Biber | 396/206 |
| 4,092,580 | | 5/1978 | Prinsze | 320/115 |
| 4,282,562 | | 8/1981 | Marino | 362/183 |
| 4,357,648 | | 11/1982 | Nelson | 362/183 |
| 4,388,673 | * | 6/1983 | Maglica | 362/183 |
| 4,398,139 | | 8/1983 | Prinsze | 320/114 |
| 4,499,525 | | 2/1985 | Mallory | 362/157 |
| 4,605,993 | | 8/1986 | Zelina, Jr. | 362/183 |
| 4,825,345 | * | 4/1989 | Stevens | 362/183 |
| 4,991,069 | | 2/1991 | Tiller | 362/183 |
| 5,008,785 | | 4/1991 | Maglica | 362/183 |
| 5,138,245 | * | 8/1992 | Mattinger et al. | 320/115 |
| 5,446,364 | * | 8/1995 | Naskali | 320/114 |
| 5,587,646 | | 12/1996 | Thomas | 362/183 |
| 5,629,105 | | 5/1997 | Matthews | 429/97 |
| 5,646,484 | | 7/1997 | Sharma | 315/74 |
| 5,772,309 | | 6/1998 | Groben | 362/183 |

OTHER PUBLICATIONS

TAC–LITE product insert, dated 1997.

Unitrode, description of bq2000, "Programmable Multi–Chemistry Fast–Charge Management IC", dated May 1999.

Maxim, description of MAX1703 "1–Cell to 3–Cell, High Power (1.5A), Low Noise, Step–Up DC–DC Converter", Rev 2, dated Nov. 1998.

Maxim, description of MAX845, "Isolated Transformer Driver for PCMCIA Applications", Rev 4, dated Oct. 1997.

* cited by examiner

*Primary Examiner*—Alan Cariaso
(74) *Attorney, Agent, or Firm*—Robert F. I. Conte; Lee, Mann, Smith, McWilliams, Sweeney & Ohlson

(57) ABSTRACT

A rechargeable flashlight, having a head end and a tail end, has an incandescent bulb disposed to direct its illumination out of the head end and has a switch accessible at the tail end. The flashlight houses an assembly of rechargeable batteries and a voltage converter that steps up the voltage provided by the rechargeable batteries and powers the incandescent bulb with the stepped-up voltage when the switch is in the "ON" position. When the switch is in the "OFF" position, the rechargeable batteries may be recharged while they are inside of the flashlight, via positive and negative contact rings disposed coaxially about the switch in the tail end of the flashlight. A recharger is positioned to provide current through the positive and negative contact rings for recharging the batteries inside the flashlight when protrusions carried on the recharger housing snap into a circumferential groove provided in the flashlight housing. The positive contact ring is electrically connected to the positive terminal of the rechargeable battery assembly via a diode that becomes forward biased during the recharge process. The diode serves to prevent current from flowing through the voltage converter or through the incandescent bulb during the recharge process.

63 Claims, 11 Drawing Sheets

RECHARGEABLE FLASHLIGHT WITH STEP-UP VOLTAGE CONVERTER AND RECHARGER THEREFOR

BACKGROUND OF THE INVENTION

1. Field of the Invention

This invention relates to flashlights and, more particularly, to rechargeable flashlights, i.e., flashlights powered by rechargeable batteries, wherein the rechargeable batteries can be recharged while they are inside of the flashlight. This invention also relates to a recharger for recharging rechargeable flashlights.

2. Description of Related Art

Application Ser. No. 08/738,858, filed on Oct. 28, 1996, and titled "Tactical Flashlight," discloses a flashlight especially adapted for use by law enforcement personnel. This patent application is co-pending with and has the same assignee as the present application. The flashlight disclosed in that application has a number of advantageous features, including a lamp and switch mounted on circuit boards for better electrical contact, an adjustable focus that would not be altered inadvertently, and a switch positioned to enhance ease of use in law enforcement situations. The flashlight is preferably powered by a pair of 3 volt lithium batteries. However, because these batteries are not rechargeable, they must be continuously replaced, thereby creating the burden on law enforcement personnel of having to maintain a supply of replacement batteries and having to determine when the batteries need to be replaced.

It is also known in the art to provide rechargeable flashlights, i.e., flashlights powered by an assembly of rechargeable batteries that can be recharged while they are inside the flashlight. For this purpose, the rechargeable flashlights are typically provided with a pair of recharging contacts that are electrically connected to the positive and negative terminals of the rechargeable battery assembly. Examples include the flashlights disclosed in U.S. Pat. Nos. 4,092,580; 4,282,562; 4,357,648; 4,605,993; 5,008,785; 5,629,105; and 5,772,309. A disadvantage of such rechargeable flashlights, however, is that the most commonly used rechargeable cells, nickel-cadmium cells, have a voltage that is much lower than that of lithium cells. As a result, the lamp does not normally illuminate as efficiently when using the same number of cells.

Sharma et al., U.S. Pat. No. 5,646,484 disclose a portable illumination system for use in applications that require a high output light source, such as heliport markers, runway lights, warning lights, road hazard and obstruction lights. The portable illumination system disclosed therein includes a DC/DC converter to step up the battery voltage to a level required to drive a high output light source, such as a 120V incandescent bulb. Sharma et al., however, do not disclose the DC/DC converter incorporated into a compact flashlight, nor do Sharma et al., disclose means for recharging the batteries while they are inside of the portable illumination system.

Accordingly, a need exists to provide a flashlight that is powered by rechargeable batteries that can be recharged while inside of the flashlight that can also provide the illumination efficiency provided by similarly-sized non-rechargeable batteries, such as lithium cells.

SUMMARY OF THE INVENTION

In a first principal aspect, the present invention provides a rechargeable flashlight assembly for use with a rechargeable electrical power source of the type having a first source terminal and a second source terminal and providing a first voltage between the first and second source terminals. The rechargeable flashlight assembly comprises a housing, first and second source contacts, a step-up voltage converter, a lamp, first and second recharging contacts, and a switch. The housing defines a chamber for receiving the rechargeable electrical power source. The first and second source contacts are disposed in the chamber for abutting the first and second power terminals of the rechargeable electrical power source, respectively, when it is in the chamber. The step-up voltage converter has an input terminal, an output terminal, and a ground terminal, and provides a second voltage at the output terminal when the first voltage is applied to the input terminal, the second voltage being higher than the first voltage. The lamp is electrically connected to the output terminal and to the ground terminal. The lamp operably produces illumination when the second voltage is to it. The switch has a first position, wherein the first source contact is electrically connected to the input terminal and the second source contact is electrically connected to the ground terminal, and a second position, wherein the first source contact is electrically connected to the first recharging contact and the second source contact is electrically connected to the second recharging contact.

In a second principal aspect, the present invention provides a rechargeable flashlight. The rechargeable flashlight comprises a housing, a rechargeable electrical power source, a step-up voltage converter, a lamp, first and second recharging contacts, and a switch. The housing defines a chamber, and the rechargeable electrical power source is disposed within the chamber. The rechargeable electrical power source has a first source terminal and a second source terminal and provides a first voltage between the first and second source terminals. The step-up voltage converter has an input terminal, an output terminal, and a ground terminal, and provides a second voltage at the output terminal when the first voltage is applied to the input terminal, the second voltage being higher than the first voltage. The lamp is electrically connected to the output terminal and to the ground terminal. The lamp operably produces illumination when the second voltage is applied to it. The switch has a first position, wherein the first source terminal is electrically connected to the input switch terminal and the second source terminal is electrically connected to the ground terminal, and a second position, wherein the first source terminal is electrically connected to the first recharging contact and the second source terminal is electrically connected to the second recharging contact.

In a third principal aspect, the present invention provides a recharger for recharging an electrical apparatus powered by a rechargeable electrical power source. The electrical apparatus has a tubular body with first and second recharging contacts disposed thereon. The first and second recharging contacts enable the rechargeable electrical power source to be recharged while it is in the electrical apparatus. The recharger comprises a housing, first and second recharger contacts and a recharger circuit. The housing has a first end, a second end, and a wall, with an axis substantially perpendicular to the wall and extending between the first and second ends. The first recharger contact for contacting the first recharging contact is disposed on the wall at a first distance from the axis, and the second recharger contact for contacting the second recharging contact is disposed in the wall at a second distance from the axis. The recharger circuit provides current through the first and second recharge contacts for recharging the rechargeable electrical power source in the electrical apparatus.

DETAILED DESCRIPTION OF THE PREFERRED EMBODIMENT

As used herein, "electrically connected" means connected via an electrically conductive pathway comprising one or more passive components, such as one or more diodes. Thus, when two components are electrically connected, current may be able to flow between them, provided that a voltage having the correct polarity is applied between them.

Figure 1:
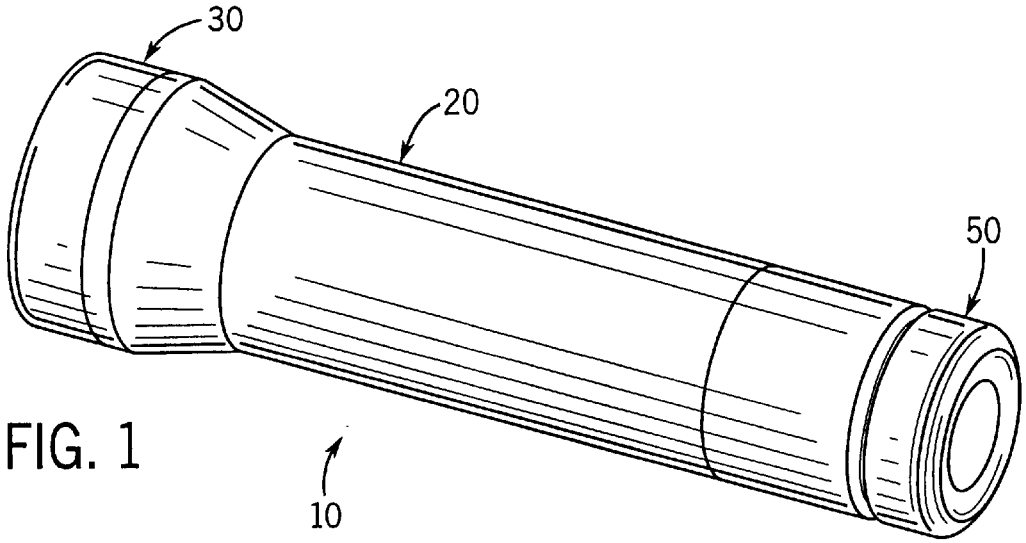
FIG. 1 is a cut-away view of the rechargeable flashlight, in accordance with a preferred embodiment of the present invention.
Figure 2:
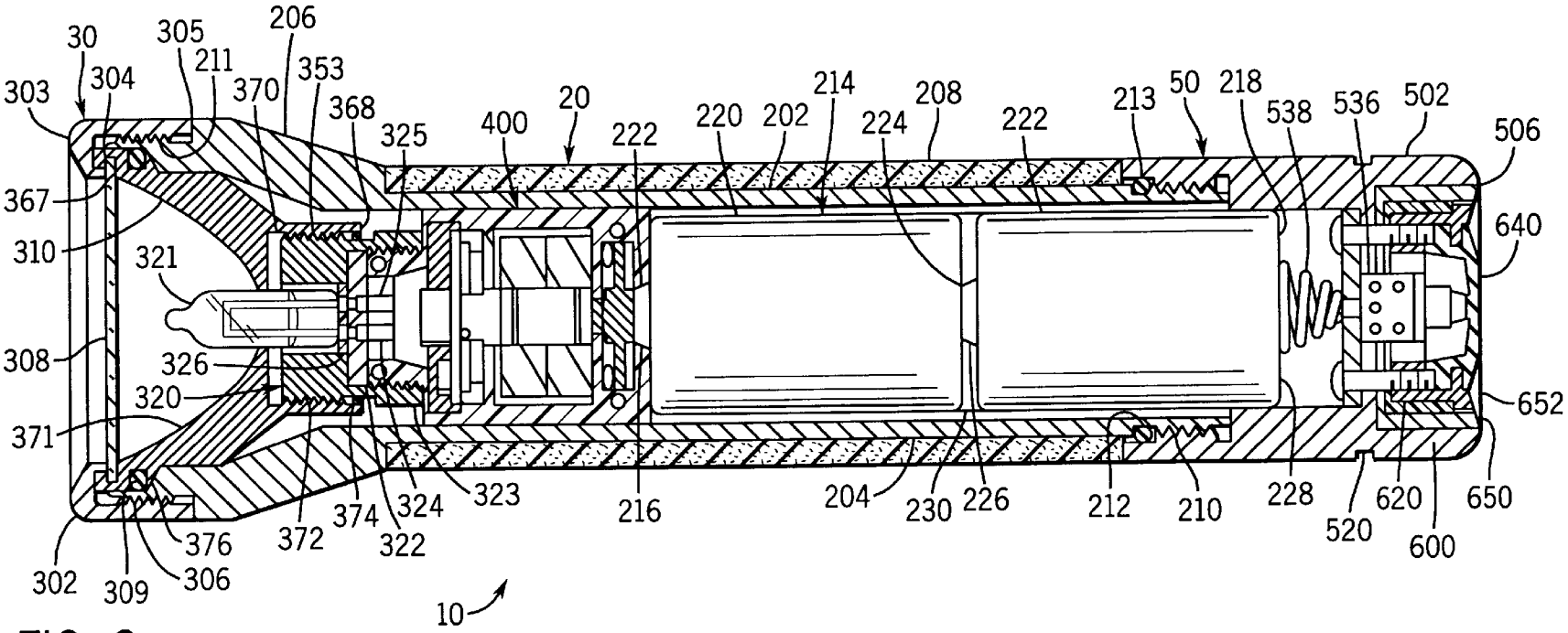
FIG. 2 is a cross-sectional side view of the rechargeable flashlight of FIG. 1, in accordance with a preferred embodiment of the present invention.

With reference to FIGS. 1 and 2, an embodiment of the rechargeable flashlight of the present invention is shown and designated as 10. Rechargeable flashlight 10 is generally comprised of a flashlight body 20, a head assembly 30, and a tailcap assembly 50. Flashlight body 20 is constructed in part of a battery tube 202, which is characterized by a barrel section 204, and an integral head section 206 having a flared or bowl shape relative to the diameter of barrel section 204. A sleeve 208 is disposed over a substantial portion of barrel section 204. A portion of barrel section 204 not covered by sleeve 208 is provided with external threads 210, and head section 206 is provided with external threads 211. Barrel section 204 has an annular groove 212, adjacent threads 210, for receipt of an o-ring 213. Barrel section 204 is disposed for receipt of a battery assembly 214 having a positive terminal 216 and a negative terminal 218.

As shown in FIG. 2, battery assembly 214 preferably comprises a first rechargeable battery 220 and a second rechargeable battery 222. Rechargeable batteries 220 and 222 are preferably each nickel-cadmium (NiCd) cells having a nominal voltage of 1.2 volts, but they could also be nickel metal-hydride (NiMH), lithium-ion (Li-ion), or other type of rechargeable electrical power source. First rechargeable battery 220 has a positive terminal 222, which preferably corresponds to positive terminal 216 of battery assembly 214, and a negative terminal 224. Second rechargeable battery 222 has a positive terminal 226 and a negative terminal 228, which preferably corresponds to negative terminal 218 of battery assembly 214. Battery assembly 214 preferably includes a tightly-fitted sheath 230 that substantially surrounds rechargeable batteries 220 and 222, leaving at least a portion of terminals 222 and 228 exposed. Sheath 230, along with tabs spot-welded between terminals 224 of 226, holds rechargeable batteries 220 and 222 together in a fixed relation, whereby positive terminal 226 of second rechargeable battery 222 is in good electrical contact with negative terminal 224 of first rechargeable battery 220. Alternatively, a molded plastic carrier (not shown) may hold batteries 220 and 222 in this fixed relation. In this way, batteries 220 and 222 are connected in series to provide battery assembly 214 with, in the preferred embodiment, a nominal voltage of 2.4 volts. Sheath 230 is preferably made from a heat-shrink plastic.

With reference to FIG. 1, head assembly 30 is comprised of a lens ring 302, a lens 308, a reflector 310, a lamp assembly 320, and a step-up voltage converter assembly 400. Lens ring 302 has a first end 303 and a second end 305. An annular shoulder 304 is disposed near first end 303 about the inner diameter of ring 302. At second end 305, ring 302 is provided with internal threads 306 for engagement with external threads 211 of head section 206, such that lens 308, reflector 310, and lamp assembly 320 are secured within the bowl of head section 206, with voltage converter assembly 400 extending into barrel section 204.

Figure 3:
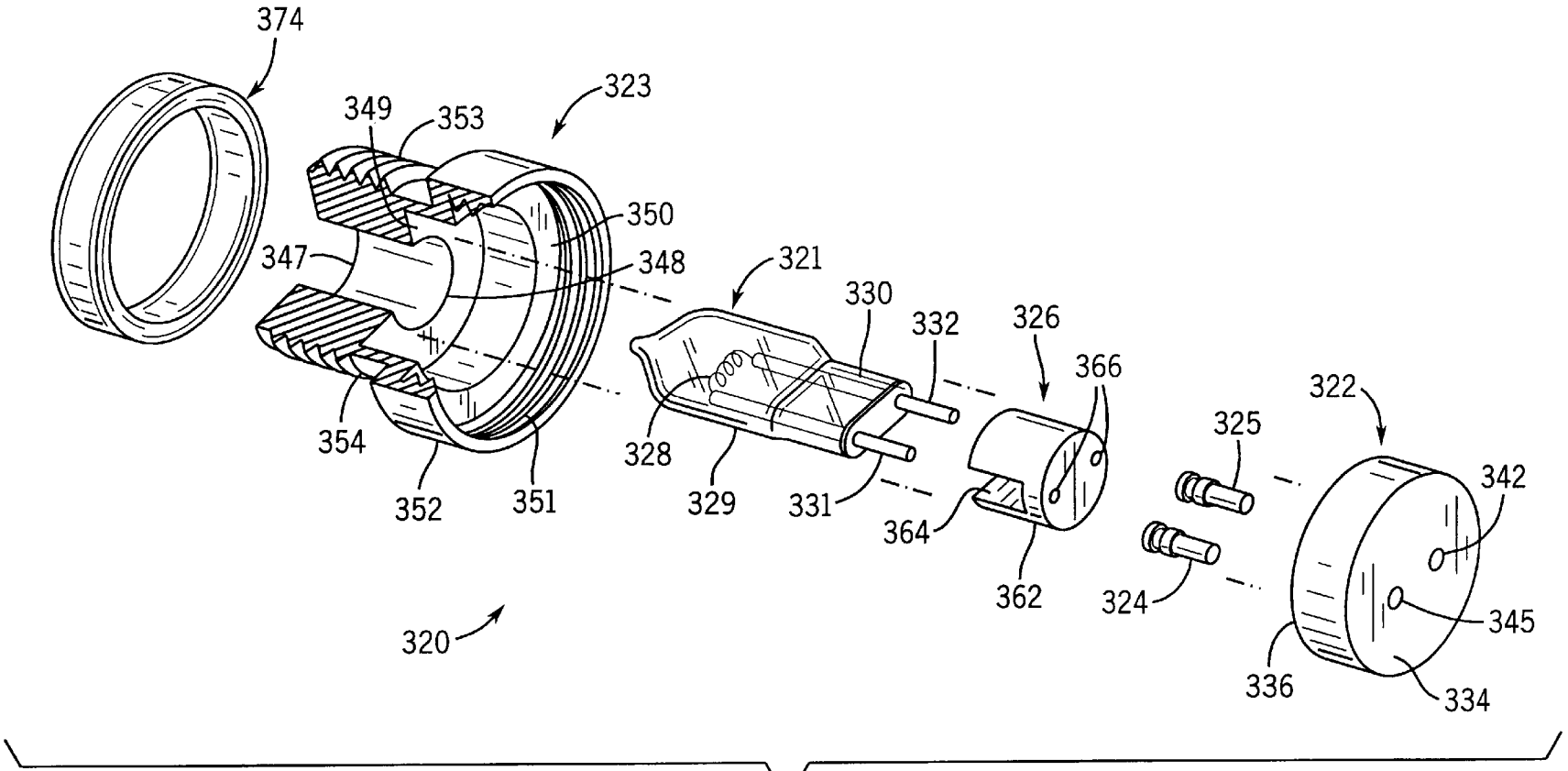
FIG. 3 is a partially cut-away exploded perspective view of the lamp assembly, in accordance with a preferred embodiment of the present invention.

With reference to FIG. 3, lamp assembly 320 includes an incandescent lamp 321, a lamp circuit board 322, a focus adjustment ring 323, a positive pin receptacle 324, a negative pin receptacle 325, and a bulb shock absorber 326. Focus adjustment ring 323 and pin receptacles 324 and 325 are formed of an electrically conductive material. Lamp 321, comprises a filament 328 disposed in a bulb 329 having a neck section 330 from which extends a positive pin 331 and a negative pin 332. Lamp 321 is preferably a halogen gas-filled type that is rated for 4.8 volts and 0.8 amps, such as model S-40-7481-01T5 from Hiyoshi Electric Co. Other lamps could also be used, however.

Lamp 321 is preferably driven by a voltage that is somewhat higher than the lamp's voltage rating. For example, the preferred 4.8 volt lamp may be driven by 5 volts d.c., as described below. The benefit of applying a voltage higher than the rated voltage is that the illumination provided by of lamp 321 increases substantially, while the life of lamp 321 decreases only slightly.

Figure 4:
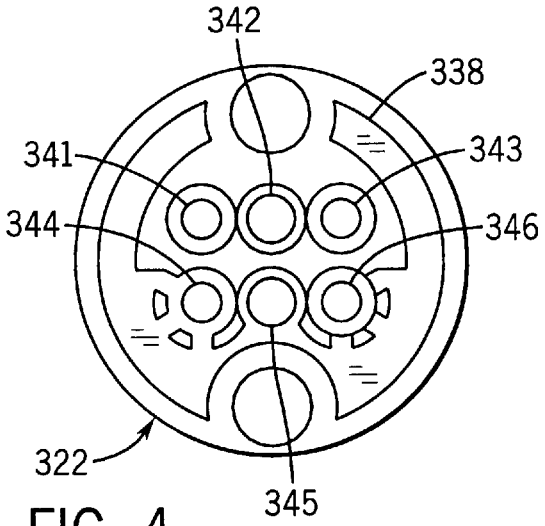
FIG. 4 is an axial view of the positive side of the lamp circuit board, in accordance with a preferred embodiment of the present invention.
Figure 5:
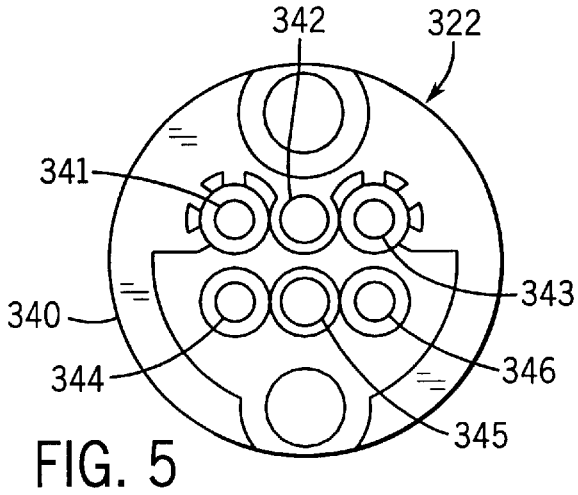
FIG. 5 is an axial view of the negative side of the lamp circuit board, in accordance with a preferred embodiment of the present invention.

With reference to FIGS. 3, 4, and 5, lamp circuit board 322 has a positive side 334 and a negative side 336. Positive side 334 is characterized by a positive electrode 338, and negative side 336 is characterized by a negative electrode 340. Lamp circuit board 322 is provided with six through holes 341–346 that extend between side 334 and side 336. Positive electrode 338 surrounds holes 344–346 on positive side 334, and negative electrode 340 surrounds holes 341–343 on negative side 336. Positive pin receptacle 324 is fitted into hole 345 so as to make good electrical contact with positive electrode 338, and negative pin receptacle 325 is fitted into hole 342 so as to make good electrical contact with negative electrode 340. Preferably, positive pin receptacle 324 is soldered to positive electrode 338 and negative pin receptacle 325 is soldered to negative electrode 340. Positive and negative pin receptacles 324 and 325 are disposed for receipt of positive and negative pins 331 and 332 of lamp 321, respectively.

With reference to FIG. 3, focus adjustment ring 323 has a through bore 347. Through bore 347 has a narrowest portion 348 and a first internal radial shoulder 349 and a second internal radial shoulder 350, which define wider portions thereof. Focus adjustment ring 323 is provided with internal threads 351 along the widest portion of through bore 347. Externally, focus adjustment ring 323 is provided with a knurled gripping surface 352 and external threads 353, with an o-ring groove 354 disposed therebetween. Lamp circuit board 322 seats through bore 347 such that negative electrode 340 abuts second shoulder 350, establishing electrical contact therebetween.

As shown in FIG. 3, shock absorber 326 comprises an annular plug 362 having an axial slot 364 and through bores 366 extending from the base of slot 364. Shock absorber 326 is disposed for receipt of lamp 321. Specifically, the narrow neck 330 of lamp 321 seats within slot 364, while positive and negative pins 331 and 332 of lamp 321 extend through bores 366. When lamp 321 is mounted in lamp circuit board 322, i.e., with positive and negative pins 331 and 332 received in positive and negative pin receptacles 324 and 325, respectively, and circuit board 322 is seated in bore 347 as described above, then shock absorber 326 is seated within narrow portion 348. Shock absorber 326 is preferably formed of a high heat material.

With reference to FIG. 2, reflector 310 is provided with a first end 367 and a second end 368. A through bore 370 extends from second end 368 and intersects the base of a parabola 371 extending from first end 367. Through bore 370 has internal threads 372 that are disposed for engagement with external threads 353 of focus adjustment ring 323. When so joined, electrical contact is established between focus adjustment ring 323 and reflector 310. With reference to FIGS. 2 and 3, an o-ring 374, which may comprise two o-rings, is mounted within groove 354 to prevent inadvertent movement of lamp assembly 320 relative to reflector 310. As explained above, reflector 310 mounts within the bowl of head section 206. Specifically, the outer surface of reflector 310 seats within head section 206 such that electrical contact is established therebetween, such as at contact surface 376.

As shown in FIG. 2, lens 308 rests against first end 367 of reflector 310. In the preferred embodiment, a gasket 309 is disposed around lens 308 to protect it and to seal it to reflector 310. Lens ring 302 fits around gasket 309 and lens 308 such that shoulder 304 abuts gasket 309. Preferably, lens 308 is set inward from first end 303 of lens ring 302. As explained above, the second end 305 is provided with internal threads 306 for engagement with external threads 211 of head section 206. When lens ring 302 is tightened onto head section 206, lens 308, reflector 310, and lamp assembly 320 are secured within the bowl of head section 206.

With reference to FIG. 2, the position of lamp assembly 320, and, thus of lamp 321, with respect to reflector 310 can be altered by means of focus adjustment ring 323. Specifically, focus adjustment ring 323 can be threaded into reflector 310 to a greater or lesser extent so as to adjust the position of lamp 321 with respect to reflector 310 and, thereby, adjust the focus of the beam provided by flashlight 10. Beneficially, however, this focus adjustment requires partial disassembly of flashlight 10, so that, during normal use, the focus of the beam will remain fixed.

Figure 6:
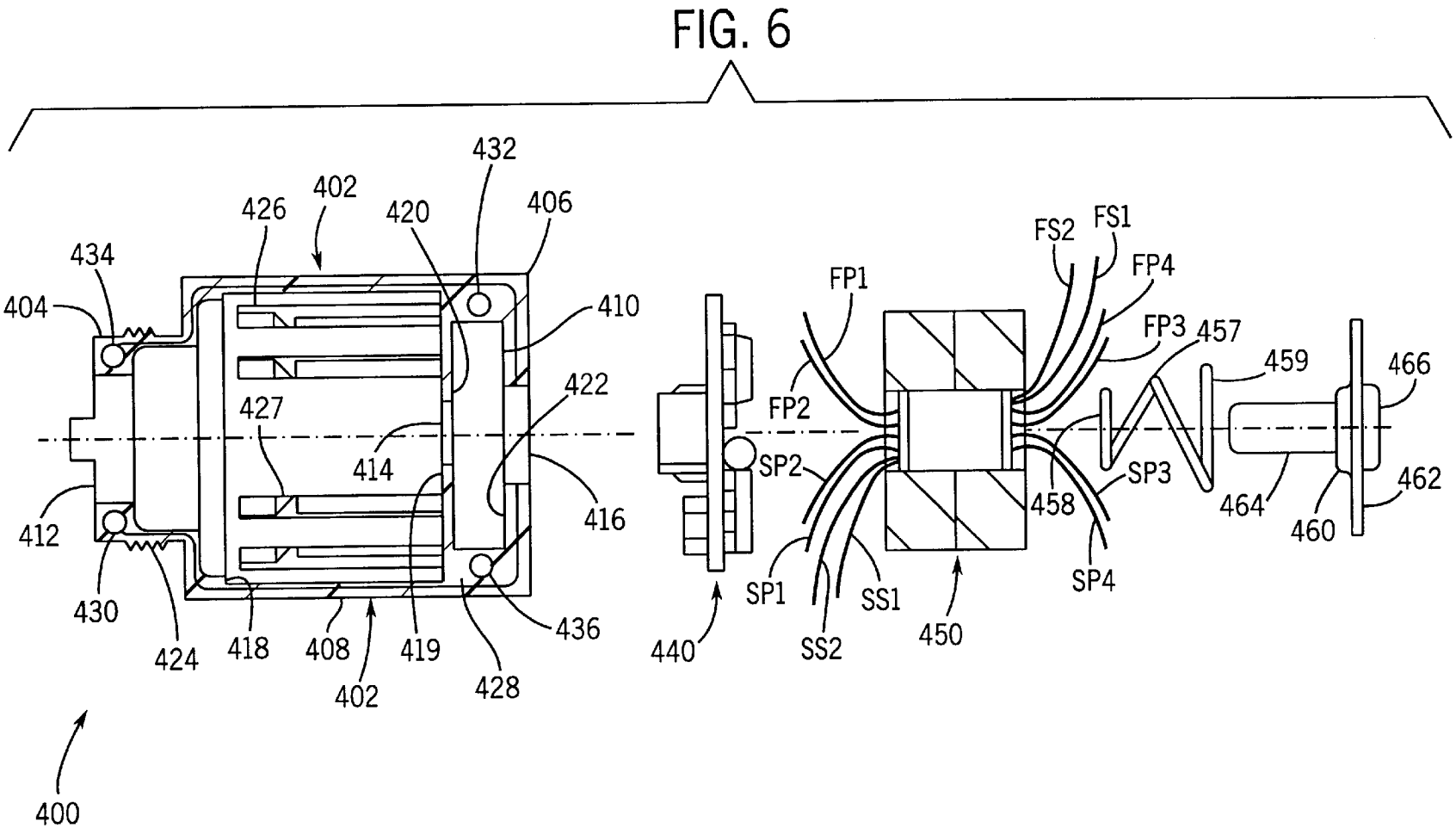
FIG. 6 is a partially exploded partially cut-away plan view of the voltage converter assembly, in accordance with a preferred embodiment of the present invention.

With reference to FIG. 6, voltage converter assembly 400 includes a housing 402 having a first end 404 and a second end 406. Housing 402 is preferably made of an electrically insulating material, such as plastic. Housing 402 defines a first interior chamber 408 and a second interior chamber 410. A first bore 412 extends between first end 404 and first chamber 408, a second bore 414 extends between first chamber 408, and a third bore extends 416 between second chamber 410 and second end 406. First chamber 408 defines shoulders 418 and 419, and second chamber defines shoulders 420 and 422. Housing 402 is provided with external threads 424 that mate with internal threads 351 of focus adjustment ring 323. Preferably, housing 402 is also provided with a plurality of axial ribs 426, each having a prong 427 extending into first chamber 408.

Housing 402 preferably comprises two halves that are substantially identical except for the direction of external threads 424. For purposes of clarity, only one half is shown in FIG. 6. Each half of housing 402 has a mating surface 428, corresponding to an axial plane of housing 402, which abuts the corresponding mating surface of the corresponding half when the halves are joined together. A pair of posts 430 and 432 are disposed on mating surface 428 that are received in corresponding sockets 434 and 436 disposed in the mating surface of the other half. The two halves are preferably secured together with an adhesive.

With reference to FIG. 6, a voltage converter circuit assembly 440, comprised of a circuit board with electronic components thereon, is disposed in first chamber 408 so as to abut shoulder 418. A transformer 450 is also disposed in first chamber 408, so as to be captured between prongs 427 and shoulder 419. As shown schematically in FIG. 14, transformer 450 has a primary 449 and a secondary 451. Primary 449 comprises a first leg 452 extending between a first end 453 and a center tap 454 and a second leg 455 extending between a second end 456 and center tap 454. First end 453 is provided with leads FP3 and FP4, center tap 454 is provided with leads SP3, SP4, FP1, and FP2, and second end 456 is provided with leads SPI and SP2. Secondary 451 is provided with leads FS1, FS2, SS1, and SS2. The leads and windings of transformer 450 are preferably made of litz wire, and the core of transformer 450 is preferably ferrite.

Voltage converter circuit assembly 440, together with transformer 450, serve to step up the voltage produced by battery assembly 214, as described in more detail below. By stepping up the voltage, a brighter lamp 321 can be used with the same size batteries. Thus, stepping up the voltage allows flashlight 10 to be made more compact.

Referring to FIG. 6, a spring 457, having a first end 458 and a second end 459, is disposed in second chamber 410 of housing 402. Also disposed in second chamber 410 is a center contact 460. Center contact 460 comprises a disk section 462, a tube section 464 extending from one side of disk section 462 and a contact surface 466 extending from the other side of disk section 462. With spring 457 and center contact 460 disposed in second chamber 410, spring 452 fits over tube section 464. First end 458 of spring 457 abuts shoulder 420, and second end 459 abuts disk section 462, thereby urging disk section 462 against shoulder 422. At least a portion of contact surface 466 extends into third bore 416.

With reference to FIG. 6, secondary winding leads SS1 and SS2 from transformer 450 extend through holes (not shown) in the circuit board of voltage converter assembly 440, extend through bore 412 of housing 402 and are received in holes 344 and 346 of lamp circuit board 322, so as to make electrical contact with electrode 338. Preferably, leads SS1 and SS2 are soldered into holes 344 and 346. Secondary winding leads FS1 and FS2 and primary winding leads FP1, FP2, FP3, FP4, SP1, SP2, SP3, and SP4 are soldered to voltage converter circuit assembly 440 at various points to define part of the circuit there, as described in more detail below.

A ground lead 470 (shown schematically in FIG. 14) extends from voltage converter circuit 440 through bore 412 and is received in, and preferably soldered into, hole 341 of circuit board 322, so as to make electrical contact with electrode 340. Ground lead 470 provides the ground for voltage circuit assembly 440. Additionally, a positive lead 480 (shown schematically in FIG. 14) extends from the circuit board of voltage converter circuit assembly 440, through a bore (not shown) in transformer 450, and is received in tube section 464 of center contact 460, making electrical contact therewith. Preferably, positive lead 480 is soldered into tube section 464. Positive lead 480 is electrically connected to a point of voltage converter circuit assembly 440 so as to be electrically interconnected with leads FS1 and FS2.

Voltage converter circuit assembly 440 further includes a steering diode 490 (shown schematically in FIG. 14), with its cathode electrically connected to positive lead 480 and its anode electrically connected to ground lead 470. Thus, positive lead 480 and ground lead 470 are electrically connected such that if ground lead 470 applies a voltage sufficient to forward bias diode 490, current is able to flow from ground lead 470 to positive lead 480. Steering diode 490 is preferably a Schottky diode, such as a B220T, or the equivalent.

Figure 7:
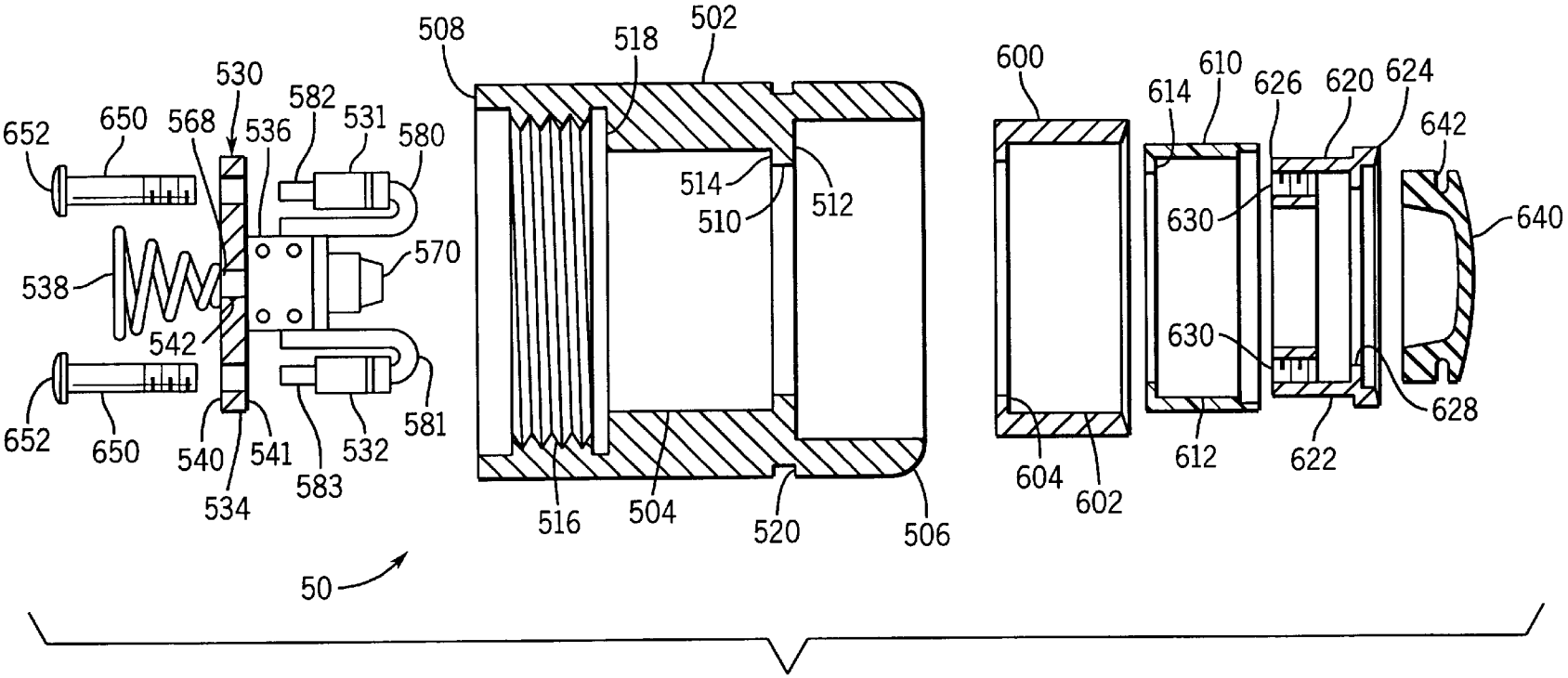
FIG. 7 is an exploded cut-away view of the tailcap assembly, in accordance with a preferred embodiment of the present invention.

With reference to FIG. 7, tailcap assembly 50 includes a tailcap 502 having an axial bore 504 extending from a first end 506 to a second end 508. Extending into axial bore 504 is an annular lip 510, which defines a first shoulder 512 on one side and a second shoulder 514 on the other side. Axial bore 504 is also provided with internal threads 516 and a third shoulder 518. Tailcap 502 is further provided with an circumferential groove 520.

Figure 8:
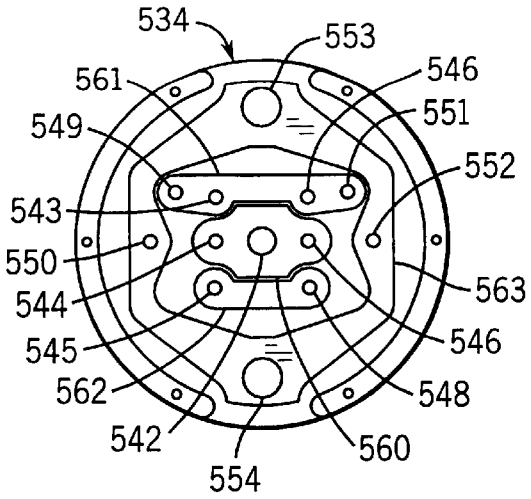
FIG. 8 is an axial view of the first side of the switch circuit board, in accordance with a preferred embodiment of the present invention.
Figure 9:
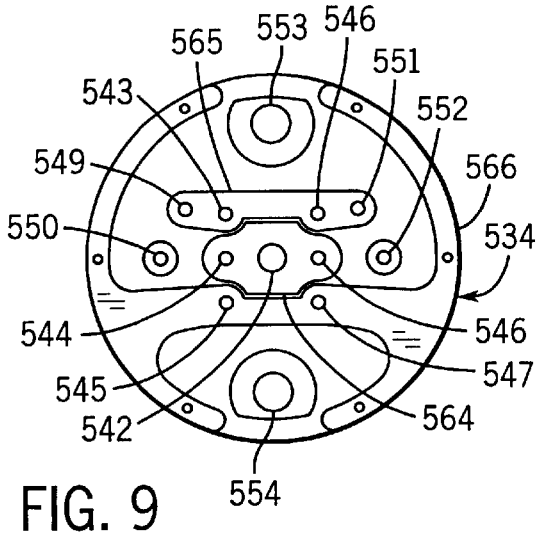
FIG. 9 is an axial view of the second side of the switch circuit board, in accordance with a preferred embodiment of the present invention.

As shown in FIG. 7, disposed within tailcap 502 is a switch assembly 530, which comprises diodes 531 and 532, a switch circuit board 534, a switch 536, and a spring 538. Switch circuit board 534 has a first side 540 and a second side 541. With reference to FIGS. 8 and 9, switch circuit board 534 is provided with a plurality of through holes that extend between first side 540 and second side 541, namely a central hole 542, six switch mounting holes 543–548, four diode mounting holes 549–552, and two fastener holes 553 and 554. Each of holes 542–554 is provided with conductive material along its length, so as to provide an electrically conductive pathway from first side 540 to second side 541.

As shown in FIG. 8, first side 540 is provided with first, second, third, and fourth conductive traces 560, 561, 562, and 563, respectively. First conductive trace 560 electrically interconnects central hole 542 and switch mounting holes 544 and 547. Second conductive trace 561 electrically interconnects switch mounting holes 543 and 546 and diode mounting holes 549 and 551. Third conductive trace 562 electrically interconnects switch mounting holes 545 and 548. Fourth conductive trace electrically interconnects diode mounting holes 550 and 552 and fastener holes 553 and 554.

As shown in FIG. 9, second side 541 is provided with fifth, sixth, and seventh conductive traces 564, 565, and 566, respectively. Fifth conductive trace 564 electrically interconnects central hole 542 and switch mounting holes 544 and 547. Sixth conductive trace 565 electrically interconnects switch mounting holes 543 and 546 and diode mounting holes 549 and 551. Seventh conductive trace 566 has a portion extending along the perimeter of second side 541 and electrically interconnects switch mounting holes 545 and 548.

Referring to FIG. 7, an electrically conductive eyelet 568 is fitted into hole 542, and preferably soldered into place, so that eyelet 568 is in good electrical contact with conductive traces 560 and 564. Eyelet 568 is connected to spring 538, so that spring 538 is also electrically connected to conductive traces 560 and 564.

With reference to FIGS. 7, 8, and 9, switch 536 is of a push-button type that is generally commercially available. Switch 536 is provided with an actuator, preferably in the form of a plunger 570, and six electrical attachment pins 571–576 (not shown). Pins 571–576 are disposed for receipt, preferably by soldering, into holes 543–548, respectively. Switch 536 is characterized by at least two positions of plunger 570, which plunger positions define which of pins 571–576 are electrically interconnected within switch 536. In a first plunger position, such as when plunger 570 is fully extended, pin 571 is electrically connected to pin 572 and pin 574 is electrically connected to pin 575, thereby electrically connecting trace 564 to trace 565 and trace 560 to trace 561. In a second plunger position, such as when plunger 570 is fully depressed, pin 572 is electrically connected to pin 573 and pin 575 is electrically connected to pin 576, thereby electrically connecting trace 564 to trace 566 and trace 560 to trace 562. Typically, when plunger 570 is only partially depressed, switch 536 provides the same electrical interconnection as in the second plunger position, with the exception that plunger 570 is not latched, i.e., it will attain its fully extended position when the applied pressure is released. Additionally, switch 536 is preferably designed for internal attachment to circuit boards used in electronic devices that are significantly free of moisture and debris. Switch 536 is also typically characterized by very quiet operation due to its size and construction.

With reference to FIG. 7, diodes 531 and 532 have cathode leads 580 and 581, connected to their respective cathodes, and anode leads 582 and 583, connected to their respective anodes. Diodes 531 and 532 are mounted on switch circuit board 534 such that cathode leads 580 and 581 are soldered into holes 550 and 552, respectively, and anode leads 582 and 583 are soldered into holes 549 and 551, respectively. Diodes 531 and 532 are preferably mounted on switch circuit board 534 perpendicularly, as shown in FIG. 6. Diodes 531 and 532 should be able, when forward biased, to withstand the currents used for recharging. For example, diodes 531 and 532 may be type 1N4001, or the equivalent.

With reference to FIGS. 2 and 7, switch assembly 530 is disposed within tailcap 502 such that conductive trace 565 on second side 541 of switch circuit board 534 abuts second shoulder 514 of annular lip 510, to provide an electrical connection therebetween. A positive contact ring 600 fits snuggly into first end 506 of axial bore 504 so as to abut first shoulder 512 of annular lip 510. Positive contact ring 600 has an axial bore 602 that defines an internal shoulder 604. An insulator ring 610 fits snuggly in axial bore 602 of positive contact ring 600 so as to abut internal shoulder 604. Insulator ring 610, in turn, has an axial bore 612 that defines an internal shoulder 614. A negative contact ring 620, in turn, fits snuggly within axial bore 612 of insulator ring 610 so as to abut internal shoulder 614. Negative contact ring 620 has an axial bore 622 extending from a first end 624 to a second end 626. Extending into axial bore 622 near first end 624 is an annular lip 628. Negative contact ring 620 also has a pair of threaded holes 630 that extend from second end 626. A switch cover 640 is integrally formed into a bowl shape with an exterior annular groove 642. Switch cover 640 fits snuggly into axial bore 622 of negative contact ring 620 such that annular groove 642 engages annular lip 628.

Positive contact ring 600 and negative contact ring 620 are made of an electrically conductive material, preferably brass. Insulator ring 610 is made of an electrically insulating material, such as plastic. Switch cover 640 is made of a flexible electrically insulating material, such as rubber. Switch cover 640 is disposed so that is axially aligned with plunger 570 of switch 536 and so that when switch cover 640 is depressed, it can, in turn, depress plunger 570. In this way, switch 536 may be operated by applying pressure through switch cover 640.

With reference to FIG. 7, a pair of threaded fasteners 650 are disposed in fastener holes 553 and 554 of switch circuit board 534 and in threaded holes 630 in negative contact ring 620. Fasteners 650 have heads 652 that abut conductive trace 563 on first side 540 of switch circuit board 534. Fasteners 650 are made of an electrically conductive material, so as to electrically connect conductive trace 563 with negative contact ring 620, via heads 652. Fasteners 650 also serve to hold switch circuit board 534 tightly against annular lip 510, so as to provide good electrical contact between conductive trace 566 against annular shoulder 514 and to hold negative contact ring tightly against insulator ring 610, to hold insulator ring 610 tightly against positive contact ring 600, and to hold positive contact ring 600 tightly against shoulder 512. In this way, a good electrical connection is provided between positive contact ring 600 and shoulder 512. Additionally, with switch cover 640 sealing fit in negative contact ring 620, switch cover 640, negative contact ring 620, insulator ring 610, and positive contact ring 600 together seal first end 506 of tailcap 502 against the entry of moisture and debris.

With reference to FIG. 2, tailcap assembly 50 is secured to barrel section 204 by the engagement of internal threads 516 on tailcap 502 with external threads 210 on barrel section 204, such that barrel section 204 abuts shoulder 518. Additionally, o-ring 213 sealingly engages bore 504, and, in the preferred embodiment, sleeve 208, disposed over barrel section 204, is of the same diameter as tailcap 502, such that sleeve 208 provides an additional seal against the migration of moisture and debris between tailcap assembly 50 and barrel section 204. Sleeve 208 is preferably formed of a foamed vinyl.

With reference to FIG. 2, positive contact ring 600, insulating ring 610, negative contact ring 620 and switch cover 640 are arranged coaxially in tailcap assembly 50, with first end 506 of tailcap 502 surrounding positive contact ring 600, which surrounds insulating ring 610, which surrounds negative contact ring 620, and with switch cover 640 at the center. Moreover, when mounted as shown in FIG. 2, positive contact ring 600 and negative contact ring 620 have exposed contact surfaces 650 and 652, respectively. Surfaces 650 and 652 are axially symmetric and slope inwardly so that switch cover 640 is recessed with respect to first end 506. This is an important advantage, in that if first end 506 were to be placed against a substantially flat surface, switch cover 640 would not be pressed inward so as to actuate switch 536.

The electrical circuit of rechargeable flashlight 10, in accordance with a preferred embodiment, will now be summarized. Referring to FIG. 2, negative terminal 218 of battery assembly 214 is in electrical contact of spring 538 bearing against it. Referring to FIGS. 7, 8, and 9, spring 538 is electrically connected to conductive traces 560 and 564 on switch circuit board 534. When plunger 570 of switch 536 is fully depressed, which corresponds to the "ON" condition of flashlight 10, traces 560 and 564 are electrically connected to trace 566, which is in electrical contact with tailcap 502. Tailcap 502 is, in turn, in electrical contact with battery tube 202, as shown in FIG. 2. Head section 206 of battery tube 202 is in electrical contact with reflector 310 via contact surface 376, and reflector 310 is in electrical contact with focus adjustment ring 323. Electrode 340 on lamp circuit board 322 abuts and is in electrical contact with focus adjustment ring 323. Finally, negative pin 332 of lamp 321 is in electrical contact with electrode 340 via pin receptacle 325. In this way, lamp 321 is electrically connected to negative terminal 218 of battery assembly 214, when switch 536 is in the "ON" position.

Figure 14:
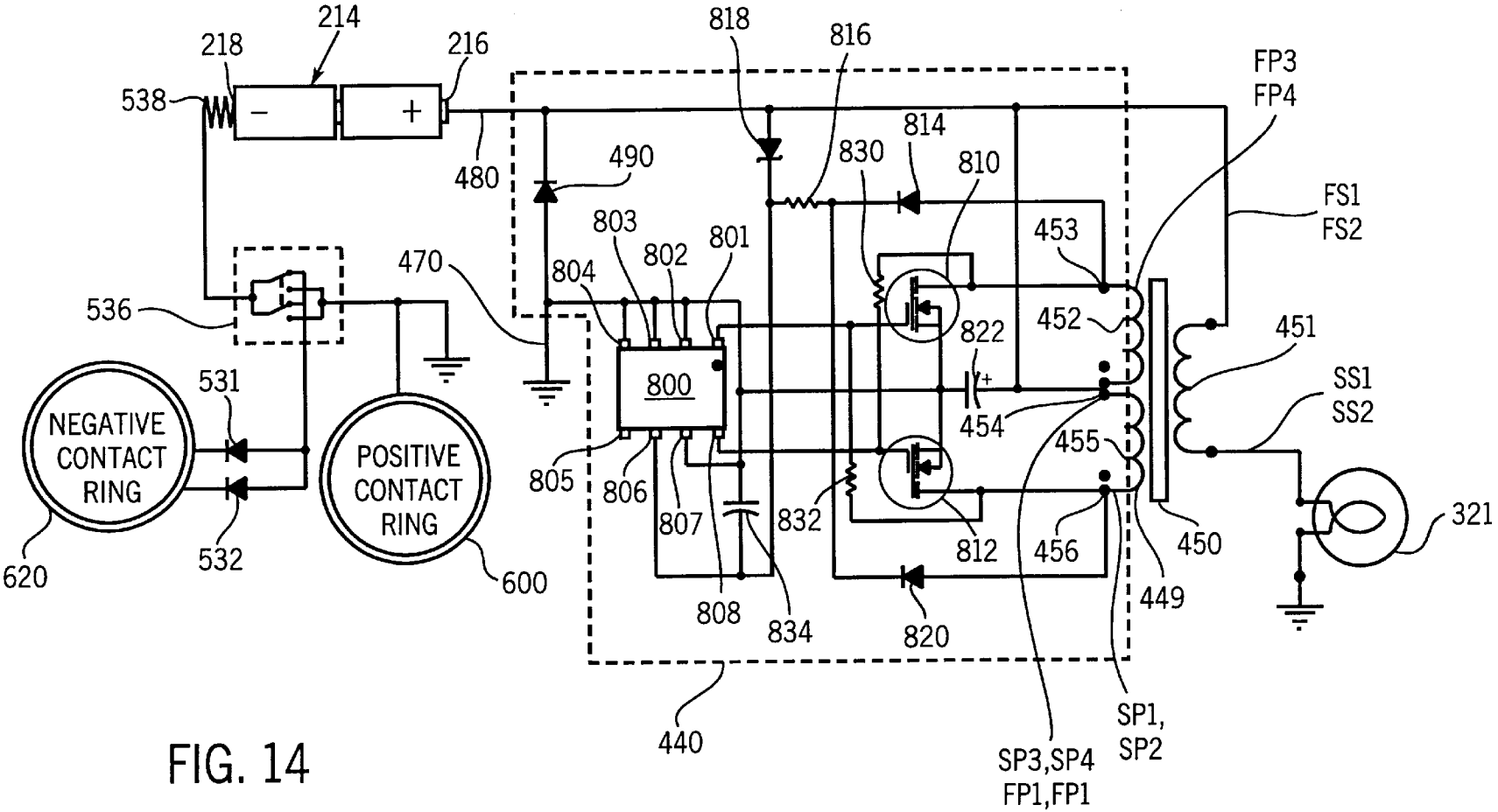
FIG. 14 is a schematic diagram of the step-up voltage converter, in accordance with a first preferred embodiment of the present invention.

As shown in FIG. 2 and 6, spring 538 also bears against battery assembly 214 so as to press positive terminal 216 against contact surface 466 of center contact 460 and make good electrical contact therebetween. With reference to FIGS. 3, 6, and 14, positive lead 480, extending from center contact 460 to voltage converter circuit assembly 440, electrically connects voltage converter circuit assembly 440 to positive terminal 216 of battery assembly 214. Ground lead 470 provides the ground for voltage converter assembly 440. Ground lead 470 is electrically connected to negative pin 332 of lamp 321, so that ground lead 470 is electrically connected to negative terminal 218 of battery assembly 214 when switch 536 is in the "ON" position, as described above. Thus, by means of positive lead 480 and negative lead 470, voltage converter assembly 440 is provided with the voltage produced by battery assembly 214, the "battery voltage." Voltage converter circuit assembly 440 and transformer 450 together step up this battery voltage to provide a stepped-up voltage, with respect to ground, as described in more detail below. Leads SS1 and SS2 then supply this stepped-up voltage to positive pin 331 of lamp 321 via electrode 338 and positive pin receptacle 324. In this way, with switch 536 in the "ON" position, lamp 321 is powered with a stepped-up voltage, i.e., a voltage that is higher than that provided by battery assembly 214.

Referring to FIGS. 7, 8, and 9, when switch 536 is in the "OFF" position, conductive traces 560 and 564, which are electrically connected to negative terminal 218 of battery assembly 214, are electrically connected to conductive traces 561 and 565. Traces 561 and 565 are, in turn, electrically connected to trace 563 via diodes 531 and 532. Heads 652 on fasteners 650 are electrically connected to trace 563, and fasteners 650 are electrically connected to negative contact ring 620. Thus, when switch 536 is in the "OFF" position, negative terminal 216 of battery assembly 214 is no longer connected to tailcap assembly 502, and the electrical connection between lamp 321 and negative terminal 218 is broken. Thus lamp 321 is not illuminated when switch 536 is in the "OFF" position. However, negative terminal 218 is electrically connected to negative contact ring 620 to allow for recharging of battery assembly 214, as described in more detail below.

Additionally, positive contact ring 600 is electrically connected to tailcap 502 and, thus, to ground lead 470 (shown schematically in FIG. 14). Ground lead 470 and positive lead 480 are electrically connected via steering diode 490, as noted above. Further, positive lead 480 is electrically connected to positive terminal 216 of battery assembly 214. Thus, positive contact ring 600 is electrically connected to positive terminal 216 of battery assembly 214 and can serve to recharge battery assembly 214 if a voltage sufficient to forward bias diode 490 is applied to it.

The design of flashlight 10 also allows simple retrofitting. Specifically, voltage converter assembly 400 can be replaced with a simple conductive piece (not shown) to allow lamp 321 to be powered by battery assembly 214 without its voltage being stepped up. Thus, with this simple alteration, flashlight 10 may also be powered by non-rechargeable batteries, such as lithium batteries.

Figure 10:
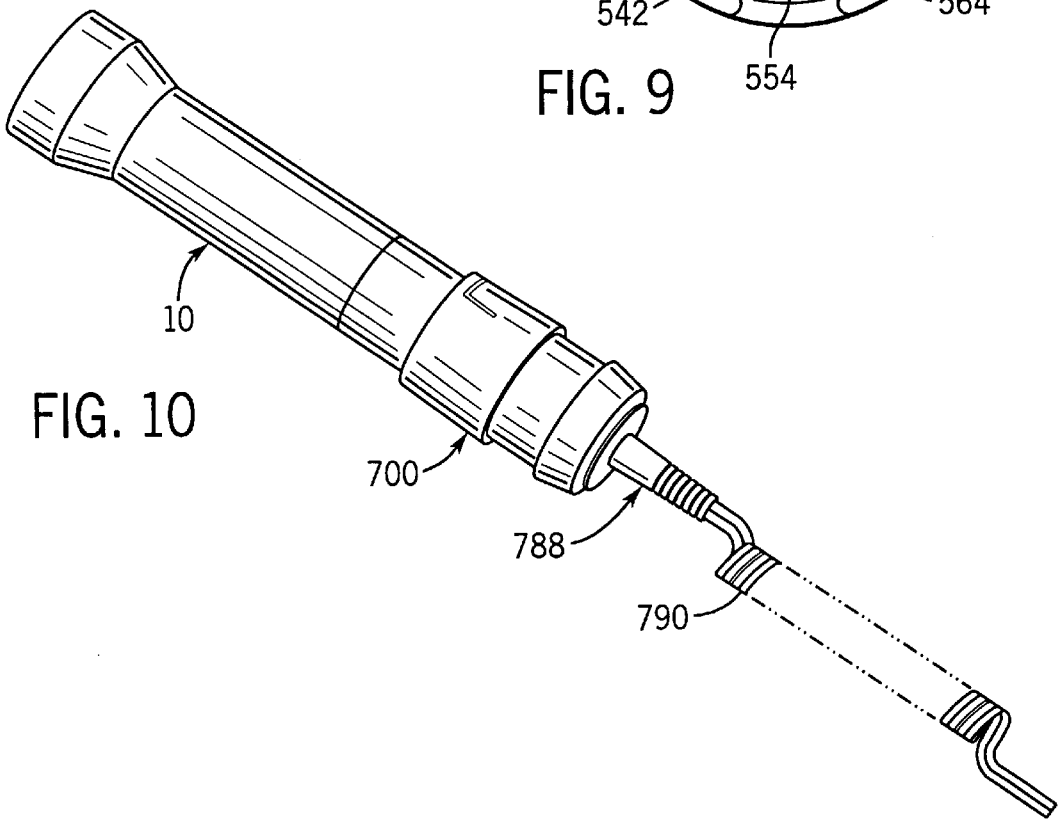
FIG. 10 is a perspective view of the recharger connected to the rechargeable flashlight of FIG. 1.
Figure 12:
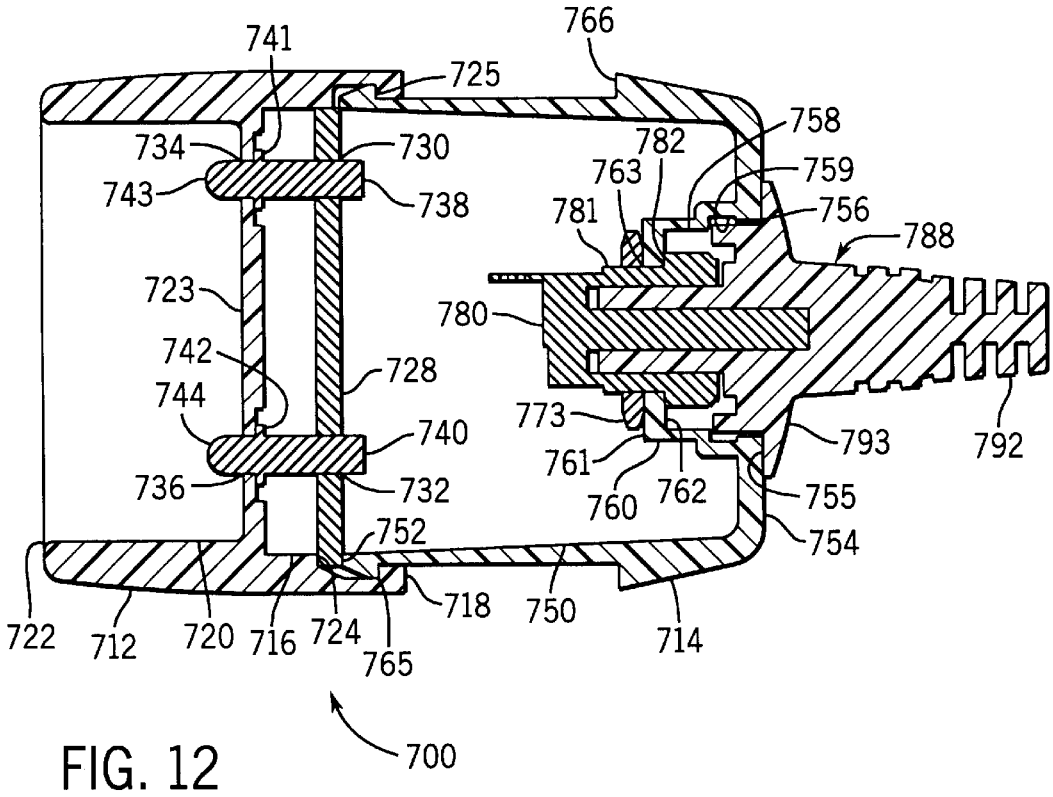
FIG. 12 is a cross-sectional side view of the recharger of FIG. 10, in accordance with a preferred embodiment of the present invention.

With reference to FIG. 10, the present invention also provides a recharger 700 that connects to rechargeable flashlight 10 for recharging battery assembly 214 while it is inside of flashlight 10. With reference to FIGS. 1 and 12, recharger 700 has a housing 710 comprising a first section 712 and a second section 714. First section 712 has a first cavity 716 extending from an open first end 718 and a second cavity 720 extending from an open second end 722. A wall 723 separates first cavity 716 and second cavity 720. First cavity 716 has a first shoulder 724 and a second shoulder 725. A pair of protrusions 726, which are carried on a pair of opposing springy tabs 727, extend into second cavity 720. A recharger circuit board 728 is disposed against first shoulder 724. Mounted on recharger circuit board 728 are electronic components (not shown) that comprise a recharger circuit 1000, which is shown schematically in FIG. 17.

Figure 13:
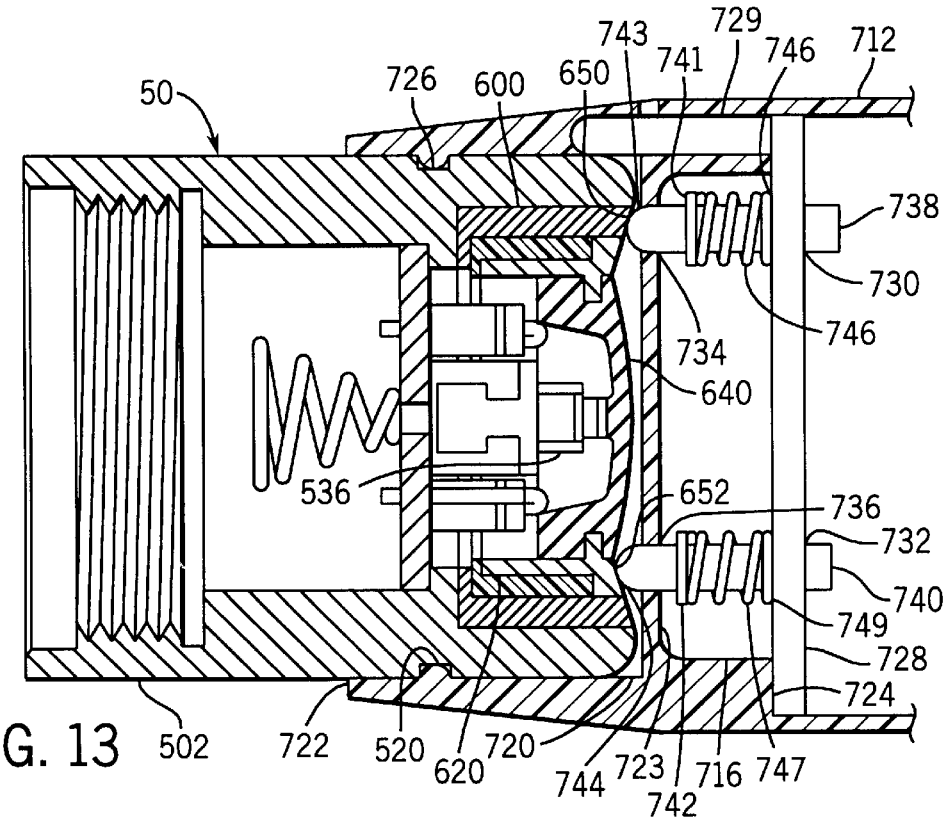
FIG. 13 is a partially cut-away side view of the tailcap assembly with recharger attached, in accordance with a preferred embodiment of the present invention.

With reference to FIG. 13, first section 712 has a blind hole 729 extending from cavity 716 toward second end 722. Mounted in blind hole 729 is a temperature sensor, such as a thermistor 1020 (shown schematically in FIG. 16). The temperature sensor in blind hole 729 is preferably electrically connected to recharger circuit 1000 by means of wires (not shown) extending from blind hole 729 to circuit board 728.

With reference to FIG. 13, recharger circuit board 728 has first and second through holes 730 and 732, and wall 723 has first and second through holes 734 and 736, axially aligned with holes 730 and 732, respectively. A positive recharger contact 738 and a negative recharger contact 740 are disposed in holes 730 and 732, respectively, so as to slide freely therethrough. Positive and negative recharger contacts 738 and 740 are also disposed in holes 734 and 736, respectively, so as to slide freely therethrough. However, positive recharger contact 738 has a flange 741 that is wider than holes 730 and 734, so that positive recharger contact 738 is captured between wall 723 and circuit board 728. Negative recharger contact 740 has a similar flange 742 so that it is also captured between wall 723 and circuit board 728. Positive and negative recharger contacts 738 and 740 also have rounded tips 743 and 744, respectively. A spring 746, disposed between flange 741 and circuit board 728, urges tip 743 of positive recharge contact 738 towards open first end 722. Similarly, a spring 747 disposed between flange 742 and circuit board 728 urges tip 744 of negative recharger contact 740 towards open first end 722. Springs 746 and 747 abut circuit board 728 at positive and negative conductive pads 748 and 749, respectively, which comprise part of recharger circuit 1000. In this way positive recharger contact 738 is electrically connected to recharger circuit 1000 via spring 746 and pad 748, and negative recharger contact 740 is electrically connected to recharger circuit 1000 via spring 747 and pad 749. Positive and negative contacts 738 and 740 are made of an electrically conductive material, preferably brass. Springs 746 and 747 are preferably silver plated for good electrical contact.

With reference to FIG. 12, second section 714 has a first cavity 750 extending from an open first end 752 and a second end 754, with a substantially flat surface 755 that defines an opening 756. A second cavity 758, having a shoulder 759, extends from opening 756. A roughly cup-shaped wall 760, having a first side 761 and a second side 762, separates first cavity 750 and second cavity 758. Wall 760 has a through hole 763 that connects first cavity 750 with second cavity 758.

Figure 11:
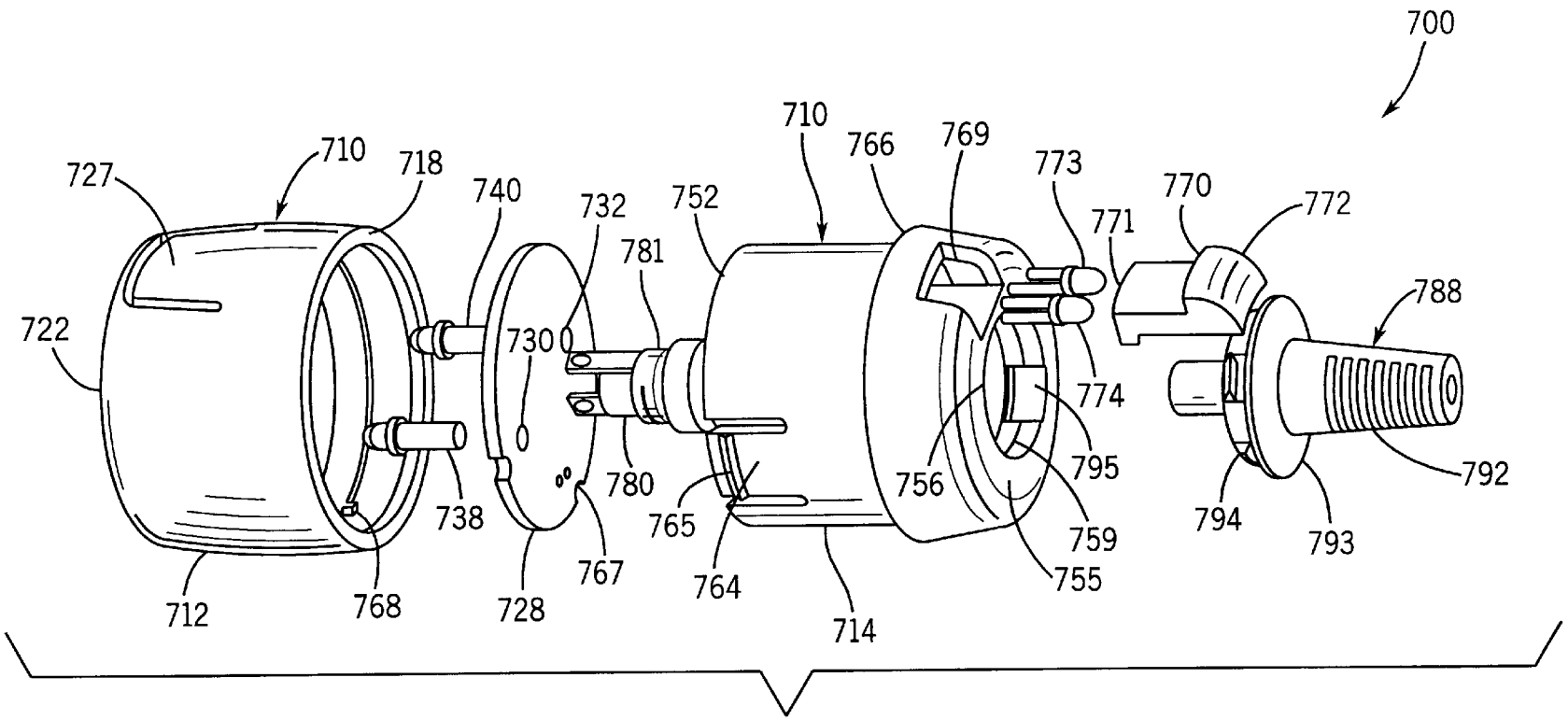
FIG. 11 is an exploded perspective view of the recharger of FIG. 10, in accordance with a preferred embodiment of the present invention.

With reference to FIGS. 11 and 12, the exterior of second section 714 has a pair of opposing springy tabs 764, each of which carries a protrusion 765. Second section 714 also has an external shoulder 766. First section 712, second section 714, and circuit board 728 fit together such that circuit board 728 is held between shoulder 724 and first end 752, with protrusions 765 held behind shoulder 725, as shown in FIG. 12. Additionally, circuit board 728 has a pair of notches 767 that are disposed to engage a pair of tabs 768 that extend into first cavity 716. With notches 767 engaged with tabs 768, circuit board 728 is beneficially prevented from rotating within first section 712.

With reference to FIG. 11, second section 714 is provided with a slot 769 that extends between cavity 750 and second end 754. A light pipe 770, having a first end 771 and a second end 772, is mounted in slot 769. A red light-emitting diode (LED) 773 and a green LED 774 are mounted within recesses (not shown) provided in first end 771 of light pipe 770. Red and green LEDS 773 and 774 are electrically connected to recharger circuit 1000 by means of wires (not shown) extending to recharger circuit board 728. Alternatively, LEDs 773 and 774 may be mounted on circuit board 728 and light pipe 770 made longer such that first end 771 reaches LEDs 773 and 774 mounted on circuit board 728. Either way, light pipe 770 directs the light emitted from LEDs 773 and 774 from first end 771 to second end 772, thus, making it easily visible to the user.

With reference to FIG. 12, a coaxial power jack 780 is provided with external threads 781 and a mounting shoulder 782. Jack 780 is preferably a model MS-14 or MS-15 sold by Shogyo International Corp. A nut 783 is threaded over external threads 781 to mount jack 780 within hole 763 such that nut 783 engages first side 761 of wall 760 and mounting shoulder 782 engages second side 762. As shown schematically in FIG. 17, jack 782 includes positive and negative supply terminals 784 and 786 electrically connected to recharger circuit 1000 by means of wires (not shown) extending to circuit board 728. The electrical power for recharger circuit 1000 is provided through supply terminals 784 and 786.

With reference to FIGS. 11 and 12, jack 780 is disposed to receive a plug 788 that is electrically connected to one end of a cord 790. Plug 788 is preferably a model MP-F17 or MP-F95 sold by Shogyo International Corp. The other end of cord 790 may be fitted with a plug (not shown) that fits into the cigarette lighter jack conventionally included in automobiles or a conventional wall cube de power supply that plugs into a conventional ac plug. Cord 790 may also be electrically connected to other power supplies, provided they deliver the sufficient voltage and current for recharger circuit 1000.

As shown in FIG. 12, plug 788 preferably has an integrally molded strain relief 792 physically connecting it to cord 790. Strain relief 792 has a flange portion 793 and four radially extending tabs 794. Opening 756 has four corresponding slots 795 disposed for receipt of tabs 794. Plug 788 is connected to second section 714, with jack 780 mounted therein in the following way. Plug 788 is inserted into opening 756 so that plug 788 electrically connects to jack 780 and tabs 794 slide into slots 795, until flange 793 abuts surface 755. Plug 788 is then rotated so that tabs 794 engage shoulder 759. In this way, strain relief 792 holds second end 754 of second section 714 between tabs 794 and flange 793, to provide a secure connection for plug 788.

As shown in FIG. 13, recharger 700 fits onto flashlight 10 such that tailcap 502 is disposed in cavity 720 and protrusions 726 are received in groove 520. Preferably, the springiness of tabs 727 allow protrusions 726 to snap into groove 520 so that recharger 700 is securely fastened to flashlight 10. In this securely fastened position, positive recharger contact 738 bears against positive contact ring 600 and negative recharger contact 740 bears against negative contact ring 620. In particular, springs 750 and 752 press tips 734 and 736 against contact surfaces 650 and 652, respectively, to provide good electrical contact therebetween. Thus, when switch 536 is the "OFF" position, recharger circuit 1000 is electrically connected to positive terminal 216, via positive contact ring 600 and positive contact 738, and to negative terminal 218, via negative contact ring 620 and negative contact 740, so as to recharge battery assembly 214 while it is inside flashlight 10.

Because positive and negative contact rings 600 and 620 are concentric and axially symmetric, contacts 738 and 740 are beneficially able to make the electrical connections needed for recharging, so long as protrusions 726 are snapped into groove 520, but regardless of how recharger 700 is oriented with respect to flashlight 10. Notably, as shown in FIG. 13, positive and negative recharger contacts 738 and 740 are disposed on wall 723 at differing distances from the longitudinal axis of recharger 700 so as to be in the proper position to contact positive and negative contact rings 600 and 620. Thus, a user does not need to position flashlight 10 into a particular rotational orientation in order to place it in recharger 700 for recharging. An additional advantage of the connection arrangement is that switch cover 640 is hidden when flashlight 10 is in recharger 700. Thus, the user is not able to turn on flashlight 10 accidentally while it is being recharged.

A first embodiment of voltage converter circuit assembly 440 is shown in more detail in FIG. 14. The components shown within the box with dashed lines in FIG. 14 are preferably mounted on a circuit board that is mounted in housing 402, as shown in FIG. 6. As described above, voltage converter circuit assembly 440 is electrically connected to positive lead 480, which is electrically connected to positive terminal 216 of battery assembly 214, and to ground lead 470, which is electrically connected to negative terminal 218 of battery assembly 214 when flashlight 10 is in the "ON" condition, to provide the ground of voltage converter circuit assembly 440. Thus, voltage converter 440 is provided with a nominal supply voltage of 2.4 volts dc in the preferred embodiment. Shown schematically in FIG. 14 are connections to voltage converter circuit assembly 440 from first end 453 of primary 449 of transformer 450 (via leads FP3 and FP4), from center tap 454 of primary 449 (via leads SP3, SP4, FP1, and FP2), from second end 456 of primary 449 (via leads SP1 and SP2) and from secondary 451 of transformer 450 (via leads FS1 and FS2). Also, as shown in FIG. 14, center tap 454 of is electrically connected to positive terminal 216.

Briefly stated, voltage converter circuit assembly 440 operates by developing an oscillating voltage from the dc voltage supplied to it by battery assembly 214 and applying this oscillating voltage to the primary of transformer 450. Transformer 450 then steps up this oscillating voltage, preferably by a factor of two, so that a stepped up oscillating voltage (with a de offset) is provided by leads SS1 and SS2, connected to the secondary of transformer 450. The voltage provided by leads SS1 and SS2 is then applied to lamp 321.

Voltage converter assembly 440 includes an oscillator circuit 800 that drives the gates of n-channel MOSFETs 810 and 812. The drain of MOSFET 810 is electrically connected to first end 453 of primary 449, and the drain of MOSFET 812 is electrically connected to second end 456 of primary 449. The sources of MOSFETs 810 and 812 are connected to ground. As noted above, center tap 454 is electrically connected to positive terminal 216 of battery assembly 214, so as to be provided with a nominal +2.4 volts dc in the preferred embodiment. When the channel of MOSFET 810 conducts, first end 453 is connected to ground through the channel of MOSFET 810, thereby allowing current to flow through first leg 452 of primary 449, from center tap 454 to first end 453. Similarly, when the channel of MOSFET 812 conducts, second end 456 is connected to ground, thereby allowing current to flow through second leg 455 from center tap 454 to second end 456.

When MOSFET 810 shuts off, after having previously been on, the leakage inductance of primary 449 causes first leg 452 to discharge through a diode 814, a resistor 816, and a zener diode 818. In particular, when first leg 452 discharges, second end 453 develops a voltage that is positive with respect to center tap 454, thereby forward biasing diode 814 and reverse biasing zener diode 818 to its breakdown voltage. Similarly, when MOSFET 812 shuts off, after having previously been on, second leg 455 discharges through a diode 820, resistor 816, and zener diode 818. Notably, throughout the discharge process, the voltage at center tap 454 remains nearly the same, +2.4 volts dc in the preferred embodiment, because it is connected to ground through a capacitor 822. Capacitor 822 preferably has a relatively large capacitance, such as 10 $\mu$F.

Resistor 816 preferably has a very low resistance, such as 10 ohms, to allow first and second legs 452 and 455 to discharge as quickly as is practicable. Resistor 816 serves to limit the current through diodes 814, 818, and 820 to a safe level. In the preferred embodiment, zener diode 818 has a nominal breakdown voltage of 3.6 volts. Diodes 814 and 820 are preferably Schottky diodes and may be provided in a dual Schottky diode package, such as a BAT54CCT, or the equivalent. MOSFETs 810 and 812 may also be conveniently provided together in a single package, such as a Si9926DY, or the equivalent.

Oscillator 800 drives the gates of MOSFETs 810 and 812 in an alternating and complementary fashion, so that when one MOSFET conducts the other does not. Thus, when current is being applied to one leg of primary 449, the other leg is discharging. Thus, primary 449 may be viewed as having approximately 2.4 volts across it one way and current flowing in one direction when MOSFET 810 is on and 2.4 volts across it the other way and current flowing in the other direction when MOSFET 812 is on. Because transformer 450 steps up by a factor of two, approximately 4.8 volts are induced across secondary 451 with varying polarity. Additionally, because secondary 451 is electrically connected to positive terminal 216 of battery assembly 214, a dc offset voltage of 2.4 volts is superimposed on this varying voltage. Thus, secondary 451 provides a voltage that varies from approximately −2.4 volts to approximately +7.2 volts for powering lamp 321.

Oscillator 800 can be provided by many different electrical circuits, as is well known in the art. However, a particularly convenient form of oscillator 800 is provided by integrated circuit MAX845, sold by Maxim Integrated Products, Sunnyvale, Calif. Maxim's data sheets for the MAX845 (Rev 4, dated October 1997) are fully incorporated herein by reference.

In this preferred embodiment, whereby oscillator circuit 800 is provided by integrated circuit MAX845, oscillator circuit 800 has eight terminals 801–808. For oscillator circuit 800 to operate as desired, terminals 802–804, and 807 are connected to ground, terminal 806 is connected to a supply voltage, and terminal 805 is unconnected. Terminal 801 drives the gate of MOSFET 810, and terminal 808 drives the gate of MOSFET 812. Each of terminals 801 and 808 are connected to a switch, internal to oscillator circuit 800, that is either connected to ground or left floating. In particular, oscillator circuit 800 drives terminals 801 and 808 in an alternating and complementary fashion, at a frequency in the range of about 450 kHz to about 700 kHz. Thus, in the first half of the cycle, terminal 801 is connected to ground and terminal 808 is left floating, while in the second half of the cycle, terminal 801 is left floating and terminal 808 is connected to ground.

Resistors 830 and 832, electrically interconnect terminals 808 and 801 with first end 453 and second end 456, respectively, to allow terminals 801 and 808 to float to the appropriate voltage. In particular, during the first half of the cycle, with terminal 801 connected to ground, MOSFET 810 is off and first leg 452 is discharging. As noted previously, when first leg 452 is discharging, first end 453 is positive with respect to center tap 454. Accordingly, resistor 830 applies a voltage to the floating terminal 808 and to the gate of MOSFET 812 that is sufficiently positive so as to turn MOSFET 812 on. Similarly, during the second half of the cycle, terminal 808 is connected to ground, thereby turning MOSFET 812 off and causing second leg 455 to discharge. The positive voltage thereby developed at second end 456 is applied, via resistor 832, to the floating terminal 801 and to the gate of MOSFET 810 to turn MOSFET 810 on.

One difficulty with using a MAX845 as the oscillator circuit 800 is that, in the preferred embodiment, battery assembly 214 supplies only 2.4 volts, whereas the MAX845 is intended to operate with a supply voltage that is at least about 3.3 volts. To overcome this potential obstacle, the supply voltage for MAX845 is provided by the positive voltages developed by the discharging of first leg 452 and second leg 455 of primary 449. Specifically, terminal 806 is connected to the junction of zener diode 818 and resistor 816, as shown in FIG. 14. Thus, terminal 806 is provided with approximately 6 volts in the preferred embodiment. As this voltage can fluctuate due to the changing voltages developed at first end 453 and second end 456, a capacitor 834 is connected between terminal 806 and ground for additional filtering.

Also shown schematically in FIG. 14 are diodes 531 and 532, switch 536, positive contact ring 600 and negative contact ring 620. When switch 536 is in the "ON" position, negative terminal 218 of battery assembly 214 is electrically connected to positive contact ring 600, which, in turn, is electrically connected to ground. Thus, when switch is in the "ON" position, the potential of positive terminal 216 appears at positive lead 480 and the potential of negative terminal 218 appears at ground lead 470, so that voltage converter 440 can operate as described above.

However, when switch 536 is in the "OFF" position, negative terminal 218 is instead electrically connected to negative contact ring 620, to allow for recharging, as described above. Additionally, when switch 536 is in the "OFF" position, positive contact ring 600 is electrically connected to positive terminal 216, to allow for recharging. In particular, positive contact ring 600 is electrically connected to positive terminal 216 via: (a) ground, lamp 321, transformer secondary 451, and positive lead 480; and (b) ground, steering diode 490, and positive lead 480. When a positive voltage is applied to positive contact ring 600 for recharging, steering diode 490 becomes forward biased with a typical voltage drop of about 0.3 volts. Thus, during recharging, diode 490 beneficially "steers" current through it, so that current does not instead flow through lamp 321 and secondary 451. Additionally, with its low forward bias voltage, diode 490 protects voltage converter 440 during the recharge process. Thus, steering diode 490 efficiently and compactly performs functions that might otherwise by performed by much bulkier switch. This is an important advantage in compact devices such as flashlight 10, wherein little space is available to accommodate additional components.

Diodes 531 and 532 also perform an important protective function. With reference to FIGS. 2 and 7, positive contact ring 600 and negative contact ring are in close physical proximity in flashlight 10. As a result, an external conductor, such as a key in a user's pocket, could accidentally electrically connect positive contact ring 600 and negative contact ring 620 when flashlight 10 is "OFF". If that were to occur, then, in the absence of diodes 531 and 532, lamp 321 would be lit as if flashlight 10 were "ON," thus unintentionally draining battery 214. Diodes 531 and 532 prevent this, because they will conduct only when negative contact ring 620 is more negative than negative terminal 218, which would not be the case if negative contact ring 620 were electrically connected to positive contact ring via an external conductor. However, diodes 531 and 532 will still allow negative terminal 218 to be recharged through negative contact ring 620, because diodes 531 and 532 would then be forward biased.

Figure 15:
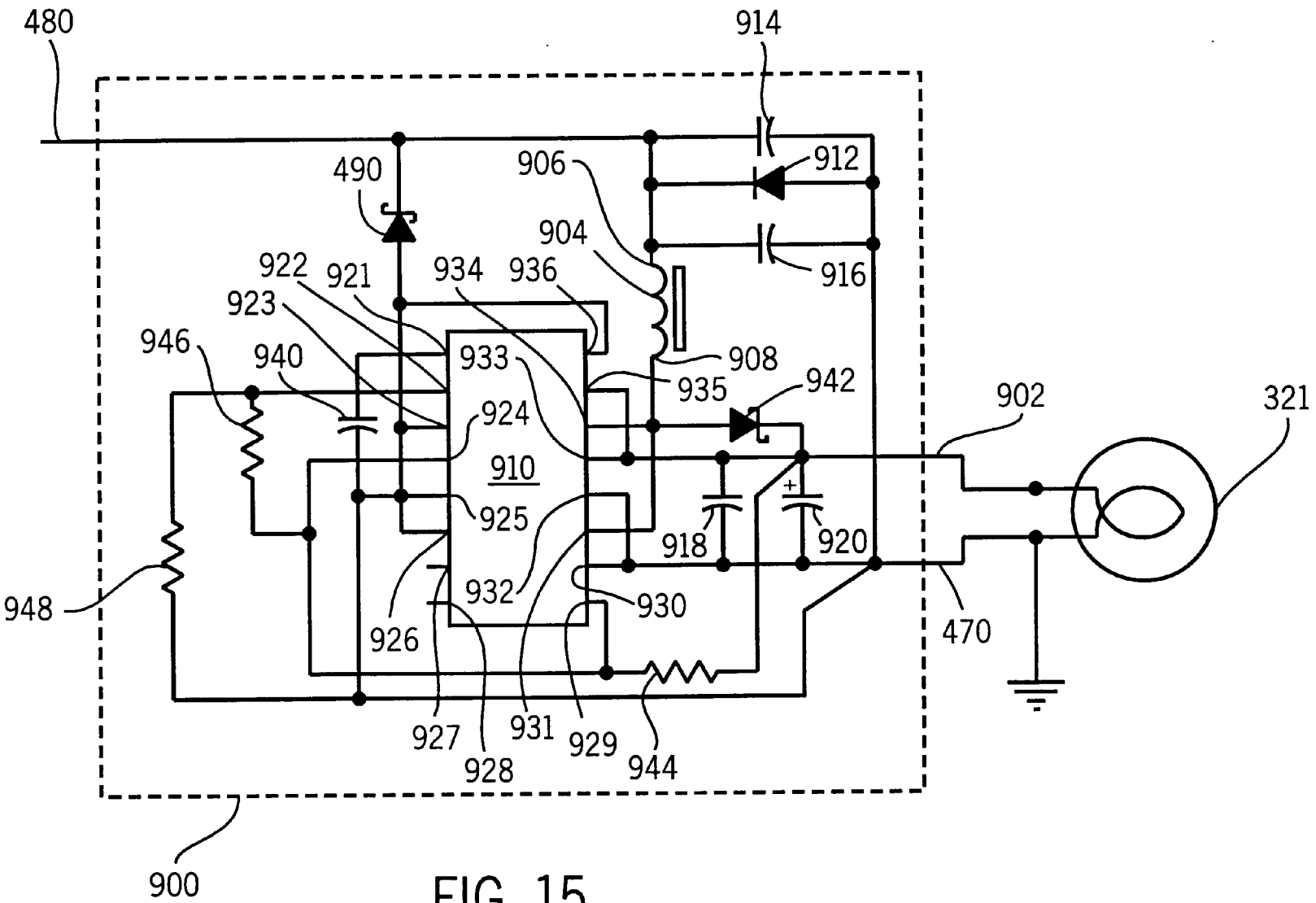
FIG. 15 is a schematic diagram of the step-up voltage converter, in accordance with a second preferred embodiment of the present invention.

Shown in FIG. 15 is an alternate embodiment for a step-up voltage converter circuit 900 that does not require the use of a transformer. Eliminating the need for transformer 450 is advantageous, as transformers like transformer 450 are typically wound by hand and can be expensive and difficult to supply. Step-up voltage converter circuit 900 also has the advantage of allowing the voltage supplied to lamp 321 to be regulated, so that circuit 900 can compensate for changes in the electrical characteristics of lamp 321 and changes in the voltage supplied by battery assembly 214. In particular, the voltage supplied by NiCd batteries, such as those used in the preferred embodiment, typically decrease as the batteries become depleted.

Like voltage converter circuit assembly 440, the components that comprise step-up voltage converter circuit 900, shown within the box with dashed lines in FIG. 15, are preferably mounted on a circuit board that is mounted in housing 402. Also like voltage converter circuit assembly 440, voltage converter circuit 900 is connected to ground lead 470 and to positive lead 480, with steering diode 490 electrically connecting positive lead 480 to ground. Voltage converter assembly 900 is also connected to lamp 321 via a power lead 902 that is soldered into one of holes 344 and 346 of lamp circuit board 322 so as to be electrically connected to electrode 338.

Voltage converter circuit 900 operates as a forward converter, converting the 2.4 volts dc supplied by battery assembly 214 in the preferred embodiment to 5 volts dc. An inductor 904 has a first end 906 electrically connected, via positive lead 480, to positive terminal 216 of battery assembly 214 and has a second end 208 electrically connected to a switching circuit 910. Switching circuit 910 alternately electrically connects second end 908 to ground and to power lead 902. When second end 908 is connected to ground, the magnitude of the current flowing through inductor 904 increases nearly linearly and first end 906 is positive with respect to second end 908. When second end 908 is electrically connected to power lead 902, inductor 908 begins to discharge, i.e., the current flowing through inductor 904 begins to decrease. When inductor 904 discharges, second end 908 develops a voltage that is positive with respect to first end 906. Inductor 904 discharges its current through switching circuit 910, power lead 902, lamp 321, ground lead 470, with a diode 912 completing the loop. Capacitors 914 and 916 are connected between first end 906 and positive lead 480 to maintain the dc potential of first end 906. Capacitors 918 and 920 are connected between power lead 902 and ground to filter the fluctuating voltage provided by inductor 904, so that power lead 902 supplies a nearly uniform 5 volts dc, in the preferred embodiment, for powering lamp 321.

Switching circuit 910 can be provided by many different electrical circuits, as is well known in the art. However, a particularly convenient form of switching circuit 910 is provided by integrated circuit MAX1703, sold by Maxim Integrated Products, Sunnyvale, Calif. Maxim's data sheets for the MAX1703 (Rev 2, dated November 1998) are fully incorporated herein by reference.

In this preferred embodiment, whereby switching circuit 910 is provided by integrated circuit MAX1703, switching circuit 910 has sixteen terminals 921–936. In this embodiment, for switching circuit 910 to operate as desired, terminals 923, 925, 926, 930, 932, and 936 are connected to ground, terminal 932 is connected to a capacitor 940, which, in turn, is connected to ground, terminals 927 and 928 are unconnected, terminal 929 is connected to terminal 924, terminals 921 and 924 are connected to second end 908 of inductor 904, and terminals 923 and 924 are electrically connected to power lead 902. Capacitor 940 preferably has a capacitance of about 0.1 $\mu$F. Additionally, a Schottky diode 942, such as an SM5817 or the equivalent, is connected between terminals 934 and 933, as shown in FIG. 15.

Switching circuit 910 includes an internal N-channel MOSFET switch (not shown), the source of which is connected to terminals 930 and 932, and the drain of which is connected to terminal 931. Switching circuit 910 also includes an internal P-channel MOSFET switch (not shown), the source of which is connected to terminals 933 and 935, and the drain of which is connected to terminal 934. Switching circuit 910 operates the internal MOSFET switches in alternating and complementary fashion. Specifically, the internal MOSFET switches are driven by an internal oscillator, running at about 300 kHz and having pulse-width modulation (PWM). When the N-channel MOSFET switch is on (and the P-channel MOSFET switch is off), terminal 931 is connected to ground and terminals 933 and 935 are left floating, thereby allowing the current flowing through inductor 904 to increase linearly, as described above. During this part of the cycle, lamp 321 is powered primarily by the discharge of capacitors 918 and 920. When the P-channel MOSFET switch is on (and the N-channel MOSFET switch is off), terminal 931 is left floating and terminal 934 is interconnected to terminals 933 and 935 (which are connected to power lead 902), thereby allowing inductor 904 to discharge through the P-channel MOSFET switch. In this way, step-up converter 900 produces a dc output voltage, $V_{out}$, that is greater than the dc voltage supplied by battery assembly 214.

This output voltage, $V_{out}$, provided by voltage convert 900 also serves to supply switching circuit 910. For this reason, terminal 924, which is where the power supply for switching circuit is connected, is connected to terminal 933, via a resistor 944. Resistor 944 has a small value, such as 10 ohms.

Additionally, when the MAX1703 integrated circuit is used for switching circuit 910, switching circuit is able to regulate the output voltage, $V_{out}$, to any value between 2.5 volts and 5.5 volts, as determined by a voltage divider comprising resistors 946 and 948. Resistor 946 is connected between terminals 922 and 924 and has a resistance $R_1$. Resistor 948 is connected between terminal 922 and ground and has a resistance $R_2$. Switching circuit 910 regulates the switching of the internal N-channel and P-channel MOSFET switches such that $V_{out}$ is about $1.24(1+R_1/R_2)$. Switching circuit 910 accomplishes this by adjusting the length of time the internal P-channel MOSFET switch is on in each cycle.

Figure 16:
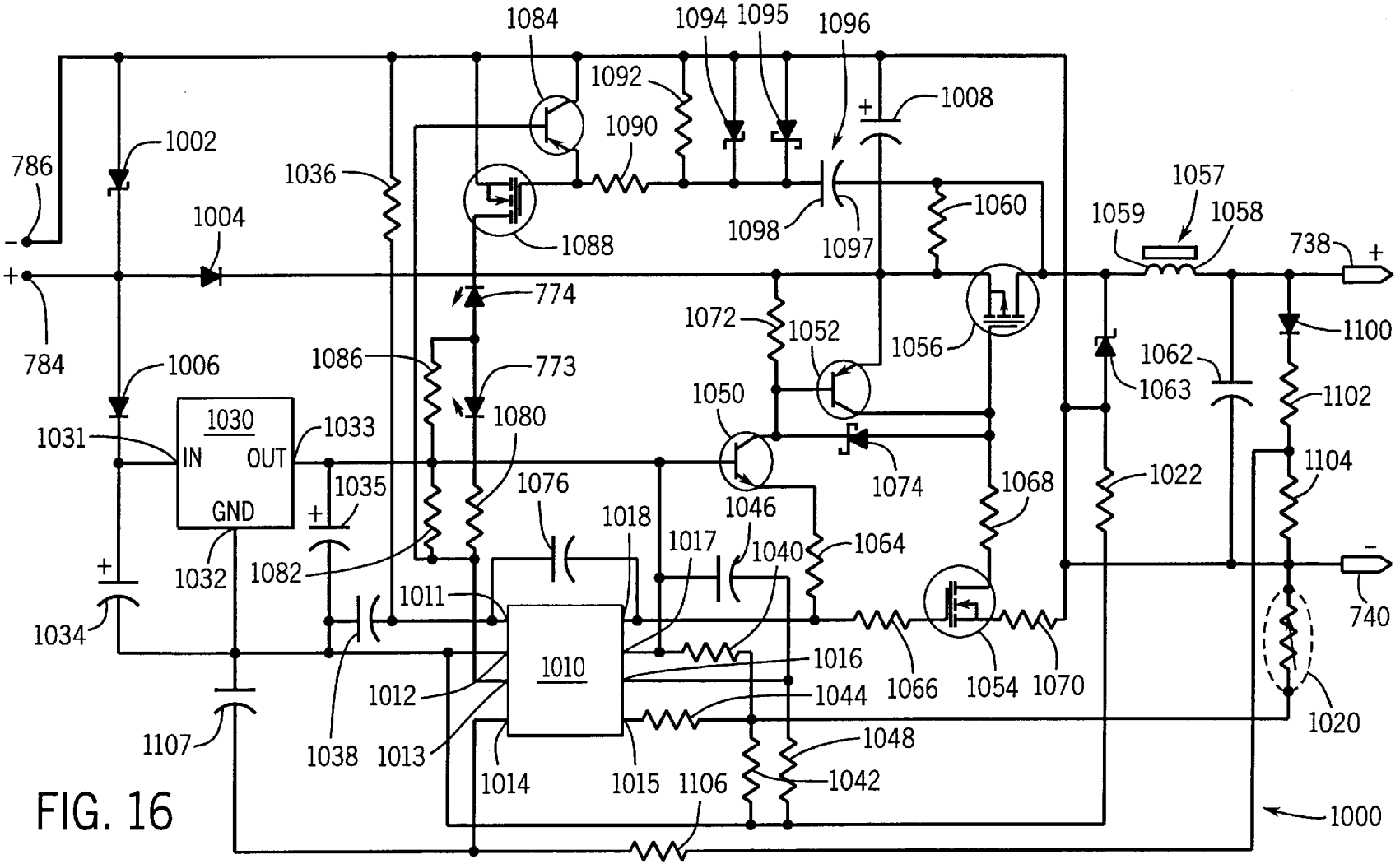
FIG. 16 is a schematic diagram of the recharger circuit, in accordance with a preferred embodiment of the present invention.

Shown schematically in FIG. 16 is recharger circuit 1000, which serves to recharge battery assembly 214 via positive recharger contact 738 and negative recharger contact 740. Recharger 1000 is preferably flexible enough so as to be able to operate when powered, via positive supply terminal 784 and negative supply terminal 786, by either by a 12.5 volt dc power supply (such as a wall cube power supply) or by an automobile battery via the cigarette lighter jack (which typically provides a dc voltage in the range of 9 to 16 volts).

Because the voltage provided at a conventional cigarette lighter jack can often have high voltage spikes, a transient voltage suppressor 1002 is preferably connected between positive and negative supply terminals 784 and 786. Transient voltage suppressor 1002 is preferably rated for 24 volts and 1500 joules, such as an SMBJ24C or the equivalent. To protect recharger circuit 1000 in case a voltage is applied to supply terminals 784 and 786 with the incorrect polarity, recharger circuit preferably includes diodes 1004 and 1006 with their anodes connected to positive supply terminal 784. Diode 1004 is preferably a DL4001, or the equivalent, and diode 1006 is preferably a LL4148, or the equivalent. A capacitor connected between the cathode of diode 1004 and negative supply terminal 786 provides additional filtering.

The recharge process in recharger circuit 1000 is controlled by a recharge controller circuit 1010. Recharge controller 1010 monitors the battery voltage, the recharge current, and the battery temperature (by means of a thermistor 1020 disposed in blind hole 729 in recharge housing 710) and controls the recharge process in an attempt to optimize it. For example, if a rechargeable battery is highly depleted, as indicated by a battery voltage that is below a predetermined threshold, then it is preferable to condition the battery with only pulses of recharge current, rather than continuous recharge current, until the battery voltage exceeds that threshold. Once the battery reaches that threshold it can accommodate a fast recharge current. When the battery is fully recharged, the battery voltage reaches a peak value and further recharging will actually reduce its voltage. Consequently, the fast recharge should cease when the battery voltage has peaked. Finally, when the battery is fully recharged, it is preferable to maintain the battery with short current pulses, rather than shutting off the recharge current completely. Accordingly, recharge controller 1010 provides several modes of operation for recharger circuit 1000, the most important of which are: (a) a charge qualification mode; (b) a fast charge mode; (c) a trickle charge mode; and (d) a sleep mode.

Recharge controller 1010 begins a recharge cycle in the charge qualification mode. In the charge qualification mode, recharge controller 1010 checks the battery voltage and the battery temperature. If the battery voltage is below a predetermined threshold, which for a 1.2 volt NiCd cell is preferably about 950 millivolts, then controller 1010 charges battery assembly 214 with a pulse of current every second. The pulse width is preferably about 34 milliseconds. Once the battery voltage exceeds the predetermined threshold, then controller 1010 enters the fast charge mode, provided the battery temperature is also within a predetermined range, i.e., if the battery temperature is neither too low nor too high.

In the fast charge mode, controller 1010 provides a nearly-continuous predetermined charging current to battery assembly 214. The predetermined charging current is preferably about 1 amp, which enables battery assembly 214 to be fully recharged in about one hour. Controller 1010 exits from the fast charge mode when any one of the following occurs: (a) a peak battery voltage is detected; (b) a maximum charge time (preferably about one hour) is reached; or (c) a maximum battery temperature is exceeded. In recharger circuit 1000, a peak battery voltage is detected when the voltage of battery assembly 214 has decreased by a predetermined amount, preferably about 3.8 millivolts per cell. Controller 1010 enters the trickle-charge mode when either a peak voltage is detected or a maximum charge time is reached. Controller 1010 ceases recharging altogether if the maximum battery temperature is exceeded.

In the trickle-charge mode, controller 1010 charges battery assembly 214 with a pulse of current every second, and the pulse width is preferably about 34 milliseconds. Controller 1010 will maintain the trickle-charge mode indefinitely, unless either the battery temperature exceeds a fault level or the battery voltage exceeds a maximum cell voltage.

In the sleep mode, controller 1010 does not enable any recharge current and shuts down all internal circuits for low power consumption. Controller 1010 enters sleep mode when battery assembly 214 is not electrically connected to recharger circuit 1000. Once battery assembly 214 is electrically connected, recharger controller 1010 exits sleep mode and enters the charge qualification mode.

Recharge controller circuit 1010 is preferably provided by integrated circuit Bq2000, which is sold by Unitrode Corp., Dallas, Tex. Unitrode's data sheets for the Bq2000 (dated May 1999) are incorporated herein by reference. Other circuits could also be used for recharge controller 1010, however.

If the Bq2000 integrated circuit is used as recharge controller 1010, then recharge controller 1010 has eight terminals 1011–1018. Terminal 1012 is connected to controller ground. Controller ground is preferably at the same potential as negative recharge contact 740. Notably, however, this controller ground, is normally slightly more positive than negative supply terminal 786. This is because a current-sensing resistor 1022 is connected between negative recharge contact 740 and negative supply terminal 786. During the recharge process, current flows from negative recharge contact 740 to negative supply terminal 786 through resistor 1022, thereby producing a voltage drop. Resistor 1022 has a very low resistance, preferably about 0.05 ohms. Thus, when a recharge current of 1 amp is used, as is preferred during the fast charge process, resistor 1022 will develop a voltage drop of 0.05 volts in the preferred embodiment.

The Bq2000 is intended to be powered by a supply voltage, $V_{CC}$, that is 5 volts, with respect to controller ground. Terminal 1017 is connected to this supply voltage, $V_{CC}$. To provide this $V_{CC}$, recharge circuit 1000 includes a three-terrninal voltage regulator 1030, with its input terminal 1031 connected to positive supply terminal 784 via diode 1006, its ground terminal 1032 connected to controller ground, and its output terminal 1033 connected to terminal 1017. Voltage regulator 1030 thus functions to provide a regulated five volt $V_{CC}$ for recharge controller 1010 from the voltage supplied by positive supply terminal 784. Voltage regulator 1030 is preferably a LM3480 or the equivalent. Capacitors 1034 and 1035 filter the voltages at input terminal 1031 and output terminal 1033, respectively.

Terminal 1011 is used to sense the recharge current, i.e., the current flowing through resistor 1022. In particular, terminal 1011 is connected to negative supply terminal 786 via a resistor 1036 so as to measure the voltage drop across resistor 1022. A capacitor 1038 is also connected between terminal 1011 and ground.

Terminal 1015 is used to measure the resistance of thermistor 1020 in order to determine the temperature of battery assembly 214. As described above, thermistor 1020 is disposed in blind hole 729 in recharger housing 710 so as to be in thermal contact with battery assembly 214. Resistors 1040 and 1042 are connected in series between $V_{CC}$, i.e., terminal 1017 and ground. Thermistor 1020 is connected between controller ground and the interconnection of resistors 1040 and 1042, and terminal 1015 is connected to the interconnection of resistors 1040 and 1042, optionally via a resistor 1044. Resistors 1040 and 1042 and thermistor 1020 comprise a voltage divider, such that terminal 1015 senses a voltage indicative of the resistance of thermistor 1020 and, hence, the temperature of battery assembly 214. Controller 1010 compares the voltage sensed at terminal 1015 with internal reference voltages to determine whether battery assembly 214 is too cold or too hot for recharging.

Terminal 1016 is connected to an RC timing network that determines the width of the current pulses applied during the charge qualification and trickle-charge modes. Specifically, terminal 1016 is connected to a capacitor 1046, which is connected to $V_{CC}$, and to a resistor 1048, which is connected to controller ground. To set the current pulse widths to be 34 milliseconds, as is preferred, capacitor 1046 preferably has a capacitance of 0.02 $\mu$F and resistor 1048 preferably has a resistance of 82 k$\Omega$.

Terminal 1018 is used to control the recharge current provided to battery assembly 214. Specifically, when the voltage on terminal 1018 goes high, i.e., near $V_{CC}$, recharge current is enabled, and when the voltage on terminal 1018 goes low, i.e., near controller ground, recharge current is inhibited. Terminal 1018 controls the flow of recharge current via an NPN transistor 1050, a PNP transistor 1052, and an N-channel MOSFET 1054, which devices, in turn, control a P-channel MOSFET 1056. Transistor 1050 is preferably a MMBT3904CT, or the equivalent. Transistor 1052 is preferably a MMBT3906CT,or the equivalent. MOSFET 1054 is preferably a 2N7002, or the equivalent. MOSFET 1056 is preferably an NDT458PCT, or the equivalent.

As shown in FIG. 16, the source of MOSFET 1056 is connected to positive supply terminal 784, via diode 1004, and the drain of MOSFET 1056 is connected to positive recharge terminal 738 via an inductor 1057. Inductor 1057 has a first end 1058 connected to positive recharge contact 738 and a second end 1059 connected to the drain of MOSFET 1056. A resistor 1060 is also connected between the source and the drain of MOSFET 1056.

When MOSFET 1056 is on, recharge current flows from positive terminal 784, through diode 1004, through the channel of MOSFET 1056, through inductor 1057, through positive recharge contact 738, and into flashlight 10, thereby forward biasing steering diode 490 and flows into assembly 214 through positive terminal 216. A return path for the recharge current is also provided. Specifically, current flows out of negative terminal 218, forward biasing diodes 531 and 532, through negative recharge contact 740, through resistor 1022 to negative supply terminal 786.

When MOSFET 1056 shuts off, this pathway for recharge current is not available. However, recharge current for battery assembly 214 continues to be provided by the discharge of inductor 1057. In particular, a Schottky diode 1063, having its anode connected to negative supply terminal 786 and its cathode connected to the drain of MOSFET 1056, acts as a "free-wheeling diode" to provide a discharge pathway for inductor 1057. Additionally, a capacitor 1062 is connected between first end 1058 of inductor 1057 and negative recharge contact 740.

When MOSFET 1056 shuts off, the current flowing through inductor 1057 starts to decrease and the polarity of the voltage across inductor 1057 reverses. The voltage of the first end 1058 of inductor 1057 remains the same, as it is connected to capacitor 1062, but the voltage of second end 1059 becomes sufficiently negative to forward bias diode 1063. In this way, current continues to flow from inductor 1057, through battery assembly 214, through resistor 1022 and back through diode 1063. However, with this large negative voltage across inductor 1057, this recharge current decreases rapidly to a steady-state value, as described below. In the preferred embodiment, inductor 1057 has an inductance of about 100 $\mu$H, capacitor 1062 has a capacitance of about 22 $\mu$F, and diode 1063 is a 1N5816M, or the equivalent.

As noted above, resistor 1060 is connected between the source and the drain of MOSFET 1056, so that when MOSFET 1056 is off a quiescent current is able to flow around it through resistor 1060. Preferably, the resistance of resistor 1060 is made sufficiently high that the quiescent current is very low, such as about 2 mA, so that the quiescent current will have a negligible recharging effect.

When MOSFET 1056 shuts off, inductor 1057 discharges, as described above, until the current flowing through it falls to the level of the quiescent current, i.e., the current reaches a steady-state value. At that point, with the magnitude of the current flowing through inductor 1057 no longer changing, the voltage across inductor goes to zero and diode 1063 is no longer forward biased.

Thus, MOSFET 1056 effectively acts as a switch for the recharge current, with the voltage on terminal 1018 controlling MOSFET 1056 via transistors 1050 and 1052 and MOSFET 1054. In particular, terminal 1018 is connected to the emitter of transistor 1050, via a resistor 1064, and is connected to the gate of MOSFET 1054 via a resistor 1066. The drain of MOSFET 1054 is connected to the gate of MOSFET 1056, via a resistor 1068, and the source of MOSFET 1054 is connected to negative supply terminal 786, optionally via a resistor 1070. The base of transistor 1050 is connected to $V_{CC}$. The collector of transistor 1050 is connected to the base of transistor 1052 and is connected to the source of MOSFET 1056 via a resistor 1072. The collector of transistor 1052 is connected to the gate of MOSFET 1056 and the emitter of transistor 1052 is connected to the source of MOSFET 1056. Additionally, a Schottky diode 1074 has its anode connected to the gate of MOSFET 1056 and its cathode connected to the collector of transistor 1050. Diode 1074 is preferably an LL46, or the equivalent.

When terminal 1018 goes high, i.e., near $V_{CC}$, transistor 1050 shuts off, as the base of transistor is also connected to $V_{CC}$. With transistor 1050 off, no pathway exists for sinking base current from transistor 1052, so that transistor 1052 is also off. However, with terminal 1018 high, the gate of MOSFET 1054 is at a high voltage with respect to its source, so that MOSFET 1054 is on. With MOSFET 1054 on, the gate of MOSFET 1056 is connected to negative supply terminal 786 via resistors 1068 and 1070. Thus, the gate of MOSFET 1056 will have a much lower voltage than the source of MOSFET 1056, with the result that MOSFET 1056 will be on.

When terminal 1018 goes low, the gate of MOSFET 1054 will fall to nearly the same voltage as its source, thereby turning it off. However, the base-emitter junction of transistor 1050 will become forward biased, thereby turning it on. With transistor 1050 on, current flows through resistor 1072, creating a voltage drop. This voltage drop forward biases the emitter-base junction of transistor 1052, thereby turning it on. The collector of transistor 1050 sinks the current from the base of transistor 1052 and the current from the collector of transistor 1052, which collector current flows through diode 1074. As shown in FIG. 16, the cathode of diode 1074 is connected to the base of transistor 1052 and is thus at a potential of about 0.6 volts below that of the source of MOSFET 1056, because the emitter-base junction of transistor 1052 is forward biased. Accordingly, the sum of the emitter-collector voltage of transistor 1052 and the forward bias voltage of diode 1074 (typically about 0.3 volts) is also equal to about 0.6 volts. Thus, the emitter-collector voltage of transistor 1052 is about 0.3 volts, with the result that MOSFET 1056 is off. Notably, however, this emitter-collector voltage is not so low as to saturate transistor 1052, and, by preventing saturation of transistor 1052, its turn off time is beneficially reduced.

In fast charge mode, recharge controller 1010 makes the voltage on terminal 1018 go high or low based on the voltage across resistor 1022, which is sensed at terminal 1011. In particular, terminal 1018 pulses high at a switching frequency, and recharge controller 1010 regulates the duty cycle so as to keep the voltage at terminal 1011 at −50 millivolts. Thus, as resistor 1022 is 0.05 ohms in the preferred embodiment, recharge controller 1010 regulates the recharge current in the fast charge mode to be one amp. A capacitor 1076 is connected between terminal 1018 and terminal 1011. Capacitor 1076 and capacitor 1038 together comprise a voltage divider that sets the loop gain of this feedback system. In the preferred embodiment capacitors 1038 and 1076 have capacitances of 2.2 nF and 4.7 pF, respectively. Additionally, capacitor 1076 and resistor 1036 together set the switching frequency of recharge controller 1010 in fast charge mode. In the preferred embodiment, with resistor 1036 having a resistance of 1.62 kΩ, the switching frequency is between 70 kHz and 85 kHz.

When recharge controller 1010 applies only pulses of recharge current, as in the charge qualification and trickle-charge modes, terminal 1018 goes high once a second for the period of time set by the RC network connected to terminal 1016, as described above.

Terminal 1013 controls red LED 773 and green LED 774 so as to provide a user-discernible positive indication of which mode recharge controller 1010 is in. Terminal 1013 is connected to the cathode of red LED 773, via a resistor 1080, to $V_{CC}$, via a resistor 1082, and to the base of a PNP transistor 1084. Transistor 1084 is preferably an MMBT3906CT, or the equivalent. The anode of red LED 773 is connected to the anode of green LED 774 and to $V_{CC}$, via a resistor 1086. The cathode of green LED 773 is connected to the drain of an N-channel MOSFET 1088. MOSFET 1088 is preferably a 2N7002, or the equivalent. The source of MOSFET 1088 and the collector of transistor 1084 are connected to negative supply terminal 786. The gate of MOSFET 1088 is connected to the emitter of transistor 1084 and to negative supply terminal 786 via resistors 1090 and 1092 connected in series. Resistors 1090 and 1092 preferably have resistances of 1.5 kΩ and 100 kΩ, respectively. A zener diode 1094 has its anode connected to negative supply terminal 786 and its cathode connected to the interconnection between resistors 1090 and 1092. Zener diode 1094 preferably has a breakdown voltage of about 6.8 volts, such as a ZMM5235B or the equivalent. A Schottky diode 1095 also has its anode connected to negative supply terminal 786 and its cathode connected to the interconnection between resistors 1090 and 1092. Schottky diode 1095 is preferably an LL46, or the equivalent. Finally, a capacitor 1096, having a first plate 1097 and a second plate 1098, has its first plate 1097 connected to the drain of MOSFET 1056 and its second plate 1098 connected to the interconnection between resistors 1090 and 1092. Capacitor 1096 preferably has a capacitance of about 1 nF.

When recharge controller 1010 is in the fast charge mode, terminal 1013 is low and able to sink current. When recharge controller 1010 is in the trickle-charge or sleep mode, terminal 1013 is left floating, i.e., has a high impedance. When recharge controller 1010 is in the charge qualification mode, terminal 1013 is low when current pulses are applied and is floating at other times.

Thus, during fast charge mode, with terminal 1013 low, red LED 773 is on. Specifically, current flows from $V_{CC}$, through resistor 1086, through red LED 774, through resistor 1080, and into terminal 1013. With terminal 1013 low, recharger controller 1010 also sinks base current from transistor 1084, thereby turning it on. With transistor 1084 on, the voltage on the gate of MOSFET 1088 is not high enough above the voltage on its source to turn it on. With MOSFET 1088 off, green LED 774 is also off.

During trickle-charge mode, with terminal 1013 presenting a high impedance, terminal 1013 can no longer sink current from red LED 773 or from the base of transistor 1084. Thus, red LED 773 and transistor 1084 will be off. With transistor 1084 off, the voltage on the gate of MOSFET 1088 is then determined by resistors 1090 and 1092, diodes 1094 and 1095, and capacitor 1096, which components act together as a peak detector, as described below.

When MOSFET 1056 has been off for a sufficiently long time that only the quiescent current flows through inductor 1057, the voltages on capacitor 1096 will have reached steady-state values. Specifically, first plate 1097 of capacitor 1096 will be at the same potential as positive recharge terminal 738, i.e., roughly 3 volts higher than the voltage of negative supply terminal 786, depending on how depleted battery assembly 214 is. Further, with no current flowing into or out of capacitor 1096, no voltage drop will appear across resistor 1092, and second plate 1098 will be at the same potential as negative supply terminal 786. Thus, the voltage at the gate of MOSFET 1088 will be the same as the voltage at its source, and MOSFET 1088 will be off.

Then, when MOSFET 1056 turns on, the voltage of positive supply terminal 784 (less the voltage across diode 1004) appears at the drain of MOSFET 1056. This pushes up the voltage on first plate 1097 several volts higher than what is was previously. The magnitude of this voltage increase will depend on how large the voltage is applied between positive and negative terminals 784 and 786, but it will be at least about 5 volts in the preferred embodiment. The voltage at second plate 1098 of capacitor 1096 will also increase by the same amount, with the result that the gate voltage on MOSFET 1088 will be sufficiently high to turn MOSFET 1088 on. With MOSFET 1088 on, current flows from $V_{CC}$, through resistor 1086, through green LED 774, through the channel of MOSFET 1088, to negative supply terminal 786, so that green LED 774 is lit.

With second plate 1098 several volts higher than negative supply terminal 786, current will flow from second plate 1098 to negative supply terminal 786, through resistor 1092 and zener diode 1094. In this way, the voltage on second plate 1098 will gradually fall to the level of negative supply terminal 786. In the preferred embodiment, the voltage on second plate 1098 will be nearly the same as the voltage of negative supply terminal 786 by the time MOSFET 1056 shuts off again, i.e., when the recharge current pulse is over. Thus, when MOSFET 1056 shuts off, the voltage on first plate 1097 abruptly decreases to the voltage on positive recharge contact 738. Consequently, the voltage on second plate 1098 also abruptly decreases by the same amount, becoming several volts more negative than negative supply terminal 786. This forward biases diode 1095, allowing the voltage on second plate 1098 to again rise to the level of negative supply terminal 786.

In this way, during trickle-charge mode, red LED 773 will be off and green LED 774 will be on during each recharge current pulse, i.e., it will flash at a rate of 1 Hz. Similarly, during sleep mode, LEDs 773 and 774 are both off because terminal 1013 presents a high impedance and no recharger current pulses are provided, i.e., MOSFET 1056 stays off. During the charge qualification mode, terminal 1013 goes low during the recharge current pulse. This turns on red LED 773 and turns on transistor 1084, thereby clamping the gate of MOSFET 1088, as in the fast charge mode. Thus, during the charge qualification mode, green LED 774 will be off and red LED 773 will flash at a rate of 1 Hz. Thus, by observing LEDs 773 and 774, the user is able to determine which mode recharge circuit 1000 is in. Moreover, the flashing of green LED 774 provides the user with a positive indication that the recharge of battery assembly 214 is complete. Additionally, by turning on LED 773, whether continuously, as in the fast charge mode, or intermittently, as in the charge qualification mode, recharge circuit 1000 provides the user with a positive indication that battery assembly 214 is still being recharged. Finally, when both LEDs are off, the user is able to determine that battery assembly 214 is not connected.

Terminal 1014 is used to sense the battery voltage. Specifically, a diode 1100, a resistor 1102, and a resistor

1104 are connected in series between positive recharge contact 738 and negative recharge contact 740, with the anode of diode 110 connected to positive recharge contact 738 and with resistor 1104 connected to negative recharge terminal 740. Together, these components provide a voltage divider. Terminal 1014 is connected to the interconnection between resistors 1102 and 1104, via a resistor 1106. In this way, terminal 1014 senses the voltage across resistor 1104. A capacitor 1107 is also connected between terminal 1014 and controller ground to filter out transient voltages.

The voltage across resistor 1104 preferably corresponds, at least approximately, to the voltage of one of batteries 220 and 222 in battery assembly 214. This is because, in the charge qualification mode, recharge controller 1010 determines whether charge conditioning is needed based on the voltage at terminal 1014. In particular, if the voltage on terminal 1014 corresponds to that of a highly depleted cell, then recharge controller 1010 applies only pulses of recharge current until the voltage on terminal 1014 rises to that of a cell that is ready for fast charging. Additionally, recharge controller 1010 exits the fast charge mode when it senses that the voltage at terminal 1014 has decreased by a predetermined amount, indicating that the battery has reached a peak voltage and is fully recharged.

However, the voltage across recharge contacts 738 and 740 is higher than the voltage actually provided by battery assembly 214. This is because, as shown in FIG. 14, steering diode 490, connected to positive terminal 216 of battery assembly 214, and diodes 531 and 532, connected in parallel to negative terminal 218, also contribute their forward bias voltages to the voltage appearing between recharge contacts 738 and 740. These forward bias voltages total about 1.0 to 1.25 volts, depending on how much current is flowing into battery assembly 214. By comparison, the voltage across battery assembly 214 will typically be about 1.8 to 2.4 volts, depending on how depleted battery assembly 214 is. Thus, the voltage across recharge contacts 730 and 740 will typically be about a third greater than the actual voltage of battery assembly 214.

Diode 1100 is included in the voltage divider so that the voltage at terminal 1014 will more accurately reflect the voltage of one cell in battery assembly 214. In particular, if the voltage divider were to consist only of resistors 1102 and 1104, then resistor 1102 would need to have roughly twice the resistance of resistor 1104 for the voltage across resistor 1104 to correspond to the voltage of one cell. However, if this were done, then the voltage decrease sensed at terminal 1014 when battery assembly 214 is fully recharged would be attenuated. Such attenuation is undesirable, because then recharge controller 1010 may not be able to accurately determine when the voltage of battery assembly 214 has peaked and, thus, is fully recharged. As a result, recharge controller 1010 might then continue in fast charge mode, even though battery assembly would be fully recharged.

To prevent such undesirable effects, diode 1100 is added in series to resistors 1102 and 1104 to compensate, at least in part, for the voltage offset created by the diodes in flashlight assembly 10, i.e., diodes 490, 531 and 532. In one embodiment, diode 1100 is a silicon rectifier, such as a LL4148 or the equivalent, and resistors 1102 and 1104 have resistances of 340 kΩ and 249 kΩ, respectively. In this way, the voltage across diode 1100 subtracts from the offset voltage created by diodes 490, 531 and 532, though it does not eliminate it altogether. Alternatively, diode 1100 may comprise a silicon diode and a Schottky diode in series, to better represent the offset created by diode 490 (a Schottky diode) and diodes 531 and 532 (which are silicon diodes). However, since the diodes in the voltage divider will have less current flowing through them than the diodes in flashlight assembly 10, their forward bias voltages will not be identical and the offset voltage will not be completely eliminated. Another approach is to use a 1.2 volt two-terminal voltage regulator, such as an ICL8069 from Maxim Integrated Products, Sunnyvale, Calif., in place of diode 1100.

The quiescent current that flows around MOSFET 1056 through resistor 1060, as described above, has two purposes in relation to the measurement of the battery voltage by terminal 1014. First, the quiescent current serves to forward bias diodes 490, 531, and 532 inside flashlight 10, so that the voltage of battery assembly 214 will appear (with an offset) across recharger contacts 738 and 740, even when MOSFET 1056 is off, as it would be during charge qualification mode. Second, it ensures that the voltage on positive recharger contact 738 will be anomalously high, i.e., close to that of positive supply terminal 784, when recharger contacts 738 and 740 are not electrically connected to battery assembly 214. In this way, recharge controller 1010 can detect when battery assembly 214 is not properly connected and then enter sleep mode.

While certain features and embodiments of the present invention have been described in detail herein, it is to be understood that the invention encompasses all modifications and enhancements within the scope and spirit of the following claims.

What is claimed is:

1. A rechargeable flashlight assembly for use with a rechargeable electrical power source of the type having a first source terminal and a second source terminal and providing a first voltage between said first and second source terminals, said rechargeable flashlight assembly comprising:

a housing defining a chamber for receiving said rechargeable electrical power source;

a first source contact disposed in said chamber for abutting said first source terminal of said rechargeable electrical power source when said rechargeable electrical power source is disposed in said chamber;

a second source contact disposed in said chamber for abutting said second source terminal of said rechargeable electrical power source when said rechargeable electrical power source is disposed in said chamber;

a step-up voltage converter, having an input terminal, an output terminal and a ground terminal, said step-up voltage converter providing a second voltage at said output terminal when said first voltage is applied to said input terminal, said second voltage being higher than said first voltage;

a lamp electrically connected to said output terminal and to said ground terminal, said lamp operably producing illumination when said second voltage is applied to it;

a first recharging contact;

a second recharging contact; and a switch, said switch having a first position wherein said first source contact is electrically connected to said input terminal and said second source contact is electrically connected to said ground terminal, said switch having a second position wherein said first source contact is electrically connected to said first recharging contact and said second source contact is electrically connected to said second recharging contact.

2. The rechargeable flashlight assembly of claim 1, further comprising:

a diode having an anode electrically connected to said first recharging contact and a cathode electrically connected to said first source contact.

3. The rechargeable flashlight assembly of claim 2, wherein said first recharging contact is electrically connected to said ground terminal.

4. The rechargeable flashlight assembly of claim 1, further comprising a diode having an anode electrically connected to said switch and a cathode electrically connected to said second recharging contact.

5. The rechargeable flashlight assembly of claim 1, wherein said housing is substantially tubular, said housing having a first end and a second end, said housing defining an axis extending between said first end and said second end.

6. The rechargeable flashlight assembly of claim 5, wherein said lamp is disposed to provide illumination out of said first end of said housing.

7. The rechargeable flashlight assembly of claim 6, wherein said first and second recharging contacts are disposed at said second end.

8. The rechargeable flashlight assembly of claim 7, wherein said first recharging contact has a first contact surface axially symmetric about said axis and said second recharging contact has a second contact surface axially symmetric about said axis.

9. The rechargeable flashlight assembly of claim 8, wherein said switch has an actuator, said actuator being accessible at said second end.

10. The rechargeable flashlight assembly of claim 9, further comprising a switch cover disposed at said second end, said actuator being accessible through said switch cover.

11. The rechargeable flashlight assembly of claim 10, wherein said first contact surface and said second contact surface are disposed at said second end coaxially about said switch cover.

12. The rechargeable flashlight assembly of claim 11, wherein said second end of said housing comprises a tailcap.

13. The rechargeable flashlight assembly of claim 12, wherein said tailcap has a distal end disposed coaxially about said first and second contact surfaces.

14. The rechargeable flashlight assembly of claim 13, wherein said first and second contact surfaces slope inwardly and said switch cover is recessed with respect to said distal end of said tailcap.

15. The rechargeable flashlight assembly of claim 14, wherein said tailcap has a circumferential groove.

16. A rechargeable flashlight assembly comprising:

a housing defining a chamber;

a rechargeable electrical power source disposed in said chamber, said rechargeable electrical power source having a first source terminal and a second source terminal and providing a first voltage between said first and second source terminals;

a step-up voltage converter, having an input terminal, an output terminal and a ground terminal, said step-up voltage converter providing a second voltage at said output terminal when said first voltage is applied to said input terminal, said second voltage being higher than said first voltage;

a lamp electrically connected to said output terminal and to said ground terminal, said lamp operably producing illumination when said second voltage is applied to it;

a first recharging contact;

a second recharging contact; and a switch, said switch having a first position wherein said first source terminal is electrically connected to said input terminal and said second source terminal is electrically connected to said ground terminal, said switch having a second position wherein said first source terminal is electrically connected to said first recharging contact and said second source terminal is electrically connected to said second recharging contact.

17. The rechargeable flashlight assembly of claim 16, further comprising:

a diode having an anode electrically connected to said first recharging contact and a cathode electrically connected to said first source terminal.

18. The rechargeable flashlight assembly of claim 17, wherein said first recharging contact is electrically connected to said ground terminal.

19. The rechargeable flashlight assembly of claim 16, further comprising a diode having an anode electrically connected to said switch and a cathode electrically connected to said second recharging contact.

20. The rechargeable flashlight assembly of claim 16, wherein said housing is substantially tubular, said housing having a first end and a second end, said housing defining an axis extending between said first end and said second end.

21. The rechargeable flashlight assembly of claim 20, wherein said lamp is disposed to provide illumination out of said first end of said housing.

22. The rechargeable flashlight assembly of claim 21, wherein said first and second recharging contacts are disposed at said second end.

23. The rechargeable flashlight assembly of claim 22, wherein said first recharging contact has a first contact surface axially symmetric about said axis and said second recharging contact has a second contact surface axially symmetric about said axis.

24. The rechargeable flashlight assembly of claim 23, wherein said switch has an actuator, said actuator being accessible at said second end.

25. The rechargeable flashlight assembly of claim 24, further comprising a switch cover disposed at said second end, said actuator being accessible through said switch cover.

26. The rechargeable flashlight assembly of claim 25, wherein said first contact surface and said second contact surface are disposed at said second end coaxially about said switch cover.

27. The rechargeable flashlight assembly of claim 26, wherein said second end of said housing comprises a tailcap.

28. The rechargeable flashlight assembly of claim 27, wherein said tailcap has a distal end disposed coaxially about said first and second contact surfaces.

29. The rechargeable flashlight assembly of claim 28, wherein said first and second contact surfaces slope inwardly and said switch cover is recessed with respect to said distal end of said tailcap.

30. The rechargeable flashlight assembly of claim 29, wherein said tailcap has a circumferential groove.

31. A recharger for recharging an electrical apparatus powered by a rechargeable electrical power source, said electrical apparatus having a tubular body, a circumferential groove, and first and second recharging contacts disposed on an end of said tubular body, said first and second recharging contacts being for recharging said rechargeable electrical power source while in said electrical apparatus, said recharger comprising:

a housing, said housing having a first end, a second end, a wall, and a protrusion, said housing defining an axis extending between said first and second ends, said protrusion engaging said circumferential groove as said electrical apparatus is axially joined to said housing;

a first recharger contact for contacting said first recharging contact, said first recharger contact being disposed on said wall at a first distance from said axis;

a second recharger contact for contacting said second recharging contact, said second recharger contact being disposed on said wall at a second distance from said axis; and a recharger circuit for providing current through said first and second recharger contacts for recharging said rechargeable electrical power source in said electrical apparatus.

32. The recharger of claim 31, wherein said housing defines a cavity extending from said wall to said second end, said first and second recharger contacts extending into said cavity.

33. The recharger of claim 32, wherein said protrusion extends into said cavity, said protrusion fitting into said circumferential groove to position said recharger so that said first recharger contact contacts said first recharging contact and said second recharger contact contacts said second recharging contact.

34. The recharger of claim 31, wherein said recharger circuit has a first mode of operation in which said recharger circuit provides a predetermined recharge current through said first and second recharger contacts for recharging said rechargeable electrical power source and a second mode of operation in which said recharger circuit provides an intermittent recharge current through said first and second recharger contacts for maintaining said rechargeable electrical power source at a recharged level.

35. A recharger for recharging an electrical apparatus powered by a rechargeable electrical power source, said electrical apparatus having a tubular body and first and second recharging contacts disposed on an end of said tubular body, said first and second recharging contacts being for recharging said rechargeable electrical power source while in said electrical apparatus, said recharger comprising:

a housing, said housing having a first end, a second end, and a wall, said housing defining an axis extending between said first and second ends;

a first recharger contact for contacting said first recharging contact, said first recharger contact being disposed on said wall at a first distance from said axis;

a second recharger contact for contacting said second recharging contact, said second recharger contact being disposed on said wall at a second distance from said axis; and a recharger circuit for providing current through said first and second recharger contacts for recharging said rechargeable electrical power source in said electrical apparatus, wherein said recharger circuit has a first mode of operation in which said recharger circuit provides a predetermined recharge current through said first and second recharger contacts for recharging said rechargeable electrical power source and a second mode of operation in which said recharger circuit provides an intermittent recharge current through said first and second recharger contacts for maintaining said rechargeable electrical power source at a recharged level, and wherein said recharger circuit activates a first user-discernible positive indication during said first mode of operation and activates a second user-discernible positive indication during said second mode of operation.

36. The recharger of claim 35, wherein said first user-discernible positive indication comprises a first light-emitting diode.

37. The recharger of claim 36, wherein said second user-discernible positive indication comprises a second light-emitting diode.

38. The recharger of claim 35, wherein said recharger circuit has a third mode of operation in which said recharger circuit provides an intermittent recharge current through said first and second recharger contacts for conditioning said rechargeable electrical power source to receive said predetermined recharge current, said recharger circuit activating a third user-discernible positive indication during said third mode of operation.

39. The recharger of claim 37, wherein said recharger circuit lights said first light-emitting diode continuously during said first mode of operation and lights said second light-emitting diode intermittently during said second mode of operation.

40. The recharger of claim 39, wherein said recharger circuit has a third mode of operation in which said recharger circuit provides an intermittent recharge current through said first and second recharger contacts for conditioning said rechargeable electrical power source to receive said predetermined recharge current, said recharger circuit lighting said first light-emitting diode intermittently during said third mode of operation.

41. The recharger of claim 31, wherein said electrical apparatus has a power switch, and wherein access to said power switch is blocked when said electrical apparatus is axially joined to said housing.

42. The recharger of claim 31, said recharger further comprising a temperature sensor for monitoring a rechargeable electrical power source temperature when said electrical apparatus is axially joined to said housing.

43. The recharger of claim 31, wherein said rechargeable electrical power source produces a source voltage, and wherein said recharger circuit includes a voltage measurement circuit for measuring a contact voltage between said first and second recharging contacts.

44. The recharger of claim 43, wherein said source voltage differs from said contact voltage by an offset voltage, and wherein said voltage measurement circuit includes compensating means for compensating, at least in part, for said offset voltage.

45. The recharger of claim 44, wherein said compensating means includes a silicon diode.

46. The recharger of claim 31, wherein said recharger circuit includes a current control network, said current control network having an on state and an off state, said current control network being in said on state continuously during said first mode of operation, said current control network being in said on state intermittently during said second mode of operation.

47. The recharger of claim 46, wherein said predetermined recharge current flows through said current control network during said first mode of operation.

48. The recharger of claim 47, wherein a quiescent current flows through said current control network when said current control network is in said off state.

49. The recharger of claim 48, wherein said current control network includes a transistor and a resistor, said resistor being connected in parallel with said transistor.

50. A rechargeable flashlight assembly comprising:

a housing defining a chamber;

a rechargeable electrical power source disposed in said chamber, said rechargeable electrical power source having a first source terminal and a second source terminal and providing a first voltage between said first and second source terminals;

a step-up voltage converter disposed in said chamber, having an input terminal, an output terminal and a ground terminal, said step-up voltage converter providing a second voltage at said output terminal when said first voltage is applied to said input terminal, said second voltage being higher than said first voltage;

a lamp electrically connected to said output terminal and to said ground terminal, said lamp operably producing illumination when said second voltage is applied to it;

a first recharging contact; and a second recharging contact.

51. The rechargeable flashlight assembly of claim 50, further comprising:

a diode having an anode electrically connected to said first recharging contact and a cathode electrically connected to said first source terminal.

52. The rechargeable flashlight assembly of claim 51, wherein said first recharging contact is electrically connected to said ground terminal.

53. The rechargeable flashlight assembly of claim 50, wherein said housing is substantially tubular, said housing having a first end and a second end, said housing defining an axis extending between said first end and said second end.

54. The rechargeable flashlight assembly of claim 53, wherein said lamp is disposed to provide illumination out of said first end of said housing.

55. The rechargeable flashlight assembly of claim 54, wherein said first and second recharging contacts are disposed at said second end.

56. The rechargeable flashlight assembly of claim 55, wherein said first recharging contact has a first contact surface axially symmetric about said axis and said second recharging contact has a second contact surface axially symmetric about said axis.

57. The rechargeable flashlight assembly of claim 56, wherein said switch has an actuator, said actuator being accessible at said second end.

58. The rechargeable flashlight assembly of claim 57, further comprising a switch cover disposed at said second end, said actuator being accessible through said switch cover.

59. The rechargeable flashlight assembly of claim 58, wherein said first contact surface and said second contact surface are disposed at said second end coaxially about said switch cover.

60. The rechargeable flashlight assembly of claim 59, wherein said second end of said housing comprises a tailcap.

61. The rechargeable flashlight assembly of claim 60, wherein said tailcap has a distal end disposed coaxially about said first and second contact surfaces.

62. The rechargeable flashlight assembly of claim 61, wherein said first and second contact surfaces slope inwardly and said switch cover is recessed with respect to said distal end of said tailcap.

63. The rechargeable flashlight assembly of claim 62, wherein said tailcap has a circumferential groove.

* * * * *